US008789931B2

(12) United States Patent
Sugahara et al.

(10) Patent No.: US 8,789,931 B2
(45) Date of Patent: Jul. 29, 2014

(54) LIQUID JETTING APPARATUS, CONNECTING STRUCTURE OF SUBSTRATE, AND METHOD FOR MANUFACTURING LIQUID JETTING APPARATUS

(71) Applicants: Hiroto Sugahara, Ama (JP); Shuhei Hiwada, Toyoake (JP)

(72) Inventors: Hiroto Sugahara, Ama (JP); Shuhei Hiwada, Toyoake (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 13/849,617

(22) Filed: Mar. 25, 2013

(65) Prior Publication Data

US 2014/0092177 A1 Apr. 3, 2014

(30) Foreign Application Priority Data

Sep. 28, 2012 (JP) ..... 2012-217122

(51) Int. Cl.

| | |
|---|---|
| ***B41J 2/045*** | (2006.01) |
| ***H04R 17/00*** | (2006.01) |
| ***B41J 2/14*** | (2006.01) |
| ***B41J 2/16*** | (2006.01) |

(52) U.S. Cl.

CPC ..... *B41J 2/14201* (2013.01); *B41J 2/1621* (2013.01)

USPC ..... 347/70; 29/25.35

(58) Field of Classification Search

CPC .... B41J 2/1612; B41J 2/1623; B41J 2/14274; B41J 2/161

USPC ..... 347/68, 70–72; 29/25.35; 310/311

See application file for complete search history.

(56) References Cited

U.S. PATENT DOCUMENTS

| | | | | |
|---|---|---|---|---|
| 7,111,927 | B2 * | 9/2006 | Kitahara | 347/68 |
| 7,229,160 | B2 * | 6/2007 | Kobayashi | 347/68 |
| 7,358,643 | B2 * | 4/2008 | Sugahara | 310/311 |
| 2006/0103268 | A1 | 5/2006 | Sugahara | |
| 2008/0157628 | A1 | 7/2008 | Sugahara | |

FOREIGN PATENT DOCUMENTS

| | | |
|---|---|---|
| JP | 9-286112 | 11/1997 |
| JP | 2006-166695 | 6/2006 |
| JP | 2010-199329 | 9/2010 |

* cited by examiner

*Primary Examiner* — An Do

(74) *Attorney, Agent, or Firm* — Frommer Lawrence & Haug LLP

(57) ABSTRACT

There is provided a liquid jetting apparatus which includes: a liquid jetting head including a channel unit and a piezoelectric actuator, an elastic deformation layer arranged on the piezoelectric actuator, a plurality of head-side contact points arranged on the elastic deformation layer, a substrate arranged to face a surface of the liquid jetting head, a plurality of substrate-side contact points arranged on the substrate, and a fixing member fixing the liquid jetting head and the substrate. When the fixing member fixes the liquid jetting head and the substrate, a portion of the elastic deformation layer, on which the head-side contact points are arranged, is sandwiched by the piezoelectric actuator and the substrate to undergo elastic deformation. The elastic deformation layer is configured to press the plurality of head-side contact points onto the substrate-side contact points by a force arising from a tendency to restore a state before elastic deformation.

28 Claims, 12 Drawing Sheets

LIQUID JETTING APPARATUS, CONNECTING STRUCTURE OF SUBSTRATE, AND METHOD FOR MANUFACTURING LIQUID JETTING APPARATUS

CROSS REFERENCE TO RELATED APPLICATION

The present application claims priority from Japanese Patent Application No. 2012-217122, filed on Sep. 28, 2012, the disclosure of which is incorporated herein by reference in its entirety.

BACKGROUND OF THE INVENTION

1. Field of the Invention

The present invention relates to a liquid jetting apparatus jetting a liquid from nozzles, a connecting structure of a substrate used in the liquid jetting apparatus and the like, and a method for manufacturing the liquid jetting apparatus.

2. Description of the Related Art

Japanese Patent Application Laid-Open No. 2010-199329 discloses an ink jetting head including a channel unit in which a plurality of nozzles and a plurality of pressure chambers in respective communication with the nozzles are formed, and a piezoelectric actuator which is configured to apply a pressure to the ink inside the pressure chambers. On the upper surface of the piezoelectric actuator, a plurality of connection terminals are arranged to correspond to the plurality of pressure chambers. Further, on a flexible wiring substrate formed by a flexible substrate, a first relay substrate and a second relay substrate, other connection terminals are provided to connect with the connection terminals arranged on the upper surface of the piezoelectric actuator. The wiring substrate is pulled out upward from the upper surface of the piezoelectric actuator, and its upper end is connected to a connector of a carriage substrate arrange above the piezoelectric actuator.

SUMMARY OF THE INVENTION

As with the above ink jetting head, when connecting the contact points of the piezoelectric actuator to the contact points of the wiring substrate, if there is any variation in height between the contact points of the piezoelectric actuator and the contact points of the substrate, then between some connection terminal(s) of the ink jetting head and the corresponding connection terminal(s) of the carriage substrate, the adhesion between those corresponding terminals is liable to be insufficient.

Further, when the substrate is fixed on the upper surface of the piezoelectric actuator, if any external force is applied to the substrate, etc., then the contact points of the substrate are liable to detachment from the contact points of the piezoelectric actuator. Further, because the contact points of the piezoelectric actuator are connected to the contact points of the substrate, if those contact points are arranged at positions facing the pressure chambers, then it is liable to inhibit the deformation of the piezoelectric layer in the portions facing the pressure chambers when driving the piezoelectric actuator. Therefore, it is necessary to arrange the contact points at positions not facing the pressure chambers. In such case, there is inevitably a decrease in the degree of freedom for arrangement of the contact points.

Further, in the above ink jetting head, the piezoelectric actuator is connected with the wiring substrate which is flexible. However, if the piezoelectric actuator is connected with a rigid substrate such as a glass epoxy substrate, an alumina substrate or the like, then such problems as described above will become especially conspicuous.

An object of the present teaching is to provide a liquid jetting apparatus, a connecting structure of substrate and a method for manufacturing the liquid jetting apparatus which are capable of reliably connecting the contact points of a substrate to the contact points provided on a structure such as a liquid jetting head or the like in the case of directly connecting the substrate to the structure such as the liquid jetting head or the like, wherein the corresponding contact points are less liable to disconnection even after the connection, and there is a high degree of freedom for arrangement of the contact points.

According to a first aspect of the present invention, there is provided a liquid jetting apparatus configured to jet a liquid including:

a liquid jetting head including:

a channel unit in which a plurality of channels including a plurality of nozzles and a plurality of pressure chambers communicating with the nozzles is formed, and a piezoelectric actuator including a piezoelectric layer stacked on the channel unit to cover the pressure chambers and a plurality of individual electrodes facing the pressure chambers;

an elastic deformation layer arranged on a surface, of the piezoelectric actuator, on a side opposite to the channel unit;

a plurality of head-side contact points arranged on a surface, of the elastic deformation layer, on a side opposite to the piezoelectric actuator, and being in electrical conduction with the individual electrodes;

a substrate arranged to face a surface, of the liquid jetting head, on a side of the piezoelectric actuator;

a plurality of substrate-side contact points arranged on a surface, of the substrate, on a side of the liquid jetting head so that the substrate-side contact points face the head-side contact points; and a fixing member configured to fix the liquid jetting head and the substrate to each other, wherein the elastic deformation layer is configured such that under a condition that the fixation member fixes the liquid jetting head and the substrate, a portion of the elastic deformation layer, on which the head-side contact points are arranged, is sandwiched by the piezoelectric actuator and the substrate to undergo elastic deformation, while pressing the head-side contact points to contact with the substrate-side contact points by a force arising from a tendency to restore a state before elastic deformation.

According to the present teaching, because the fixing member fixes the liquid jetting head and the substrate, a portion of the elastic deformation layer, on which the head-side contact points are arranged, is sandwiched by the piezoelectric actuator and the substrate to undergo elastic deformation, while causing the head-side contact points to contact with the substrate-side contact points by a force arising from a tendency for the elastic deformation layer to restore a state before elastic deformation. By virtue of this, it is possible to increase the adhesion between the head-side contact points and the substrate-side contact points, and thus to reliably connect the head-side contact points and the substrate-side contact points. Further, in case there is any variation of height in the head-side contact points and/or in the substrate-side contact points, because the elastic deformation layer undergoes elastic deformation, it is still possible to cause the head-side contact points to reliably contact with the substrate-side contact points.

Further, according to the present teaching, because the head-side contact points are caused to contact with the substrate-side contact points by a force arising from a tendency for the elastic deformation layer to restore the state before elastic deformation, when some external force is applied to the substrate, the substrate-side contact points are less likely to be detached from the head-side contact points.

Further, according to the present teaching, because the elastic deformation layer capable of elastic deformation is arranged between the piezoelectric layer and the head-side contact points, even though the head-side contact points are arranged at the positions facing the pressure chambers, when driving the piezoelectric actuator, it is still possible to restrain inhibition of deformation of the portions, facing the pressure chambers, of the piezoelectric layer. Therefore, in the present teaching, it is also possible to arrange the head-side contact points on a surface of the elastic deformation layer on the opposite side to the piezoelectric actuator, either in portions facing the pressure chambers or in portions not facing the pressure chambers. By virtue of this, the degree of freedom increases for arrangement of the head-side contact points.

According to a second aspect of the present teaching, there is provided a connecting structure of substrate including:

a substrate;

a structure arranged to face the substrate;

an elastic deformation layer arranged on a surface of the structure on a side of the substrate, and sandwiched by the substrate and the structure;

a plurality of structure-side contact points arranged on a surface of the elastic deformation layer on a side of the substrate to be in electrical conduction with the structure;

a plurality of substrate-side contact points arranged on a surface of the substrate on a side of the structure to face the plurality of structure-side contact points; and a fixing member configured to fix the substrate and the structure to each other, wherein the elastic deformation layer is configured such that under a condition that the fixing member fixes the substrate and the structure, a portion of the elastic deformation layer, on which the structure-side contact points are provided, is sandwiched by the substrate and the structure to undergo elastic deformation, while pressing the plurality of structure-side contact points to contact with the substrate-side contact points by a force arising from a tendency to restore a state before elastic deformation.

According to the present teaching, because the fixing member fixes the structure and the substrate, a portion of the elastic deformation layer, on which the structure-side contact points are arranged, is sandwiched by the structure and the substrate to undergo elastic deformation, while causing the structure-side contact points to contact with the substrate-side contact points by a force arising from a tendency for the elastic deformation layer to restore a state before elastic deformation. By virtue of this, it is possible to increase the adhesion between the structure-side contact points and the substrate-side contact points, and thus to reliably connect the structure-side contact points and the substrate-side contact points. Further, in case there is any variation occurring in the positions of the plurality of the structure-side contact points in the direction of the structure facing the substrate due to some variation of thickness, etc., in the elastic deformation layer before elastic deformation, because the elastic deformation layer undergoes elastic deformation, it is still possible to cause the structure-side contact points to reliably adhere to the substrate-side contact points.

Further, according to the present teaching, because the structure-side contact points are caused to contact with the substrate-side contact points by a force arising from a tendency for the elastic deformation layer to restore the state before elastic deformation, when some external force is applied to the substrate, the substrate-side contact points are less likely to be detached from the structure-side contact points.

According to a third aspect of the present teaching, there is provided a method for manufacturing a liquid jetting apparatus, the liquid jetting apparatus including:

a liquid jetting head including:

a channel unit in which liquid channels including a plurality of nozzles and a plurality of pressure chambers communicating with the nozzles is formed, and a piezoelectric actuator including a piezoelectric layer stacked on the channel unit to cover the plurality of pressure chambers and having a plurality of individual electrodes arranged on a surface of the piezoelectric layer on a side opposite to the channel unit to face the pressure chambers; and a substrate arranged to face a surface of the liquid jetting head on a side of the piezoelectric actuator, wherein a plurality of substrate-side contact points are arranged on a surface of the substrate on a side of the liquid jetting head to correspond respectively to the individual electrodes, the method including:

forming an elastic deformation layer on a surface of the piezoelectric actuator on a side opposite to the channel unit;

forming a plurality of head-side contact points on a surface of the elastic deformation layer on a side of the substrate in portions respectively facing the substrate-side contact points to be in electrical conduction with the plurality of individual electrodes; and fixing the liquid jetting head and the substrate to each other with a fixing member, wherein fixing the liquid jetting head and the substrate to each other with the fixing member causes a portion of the elastic deformation layer, on which the head-side contact points are arranged, to be sandwiched by the piezoelectric actuator and the substrate and thus to undergo elastic deformation, while pressing the head-side contact points to contact with the substrate-side contact points by a force arising from a tendency for the elastic deformation layer to restore a state before elastic deformation.

According to the present teaching, because the fixing member fixes the liquid jetting head and the substrate, a portion of the elastic deformation layer, on which the head-side contact points are arranged, is sandwiched by the piezoelectric layer and the substrate to undergo elastic deformation, while causing the head-side contact points to contact with the substrate-side contact points by a force arising from a tendency for the elastic deformation layer to restore a state before elastic deformation. By virtue of this, it is possible to increase the adhesion between the head-side contact points and the substrate-side contact points, and thus to reliably connect the head-side contact points and the substrate-side contact points. Further, in case there is any variation occurring in the positions of the head-side contact points in the direction of the liquid jetting head facing the substrate due to some variation of thickness, etc., in the elastic deformation layer before elastic deformation, because the elastic deformation layer undergoes elastic deformation, it is still possible to cause the head-side contact points to reliably contact with the substrate-side contact points.

DESCRIPTION OF THE PREFERRED EMBODIMENT

A preferred embodiment of the present teaching will be explained below.

Figure 1:
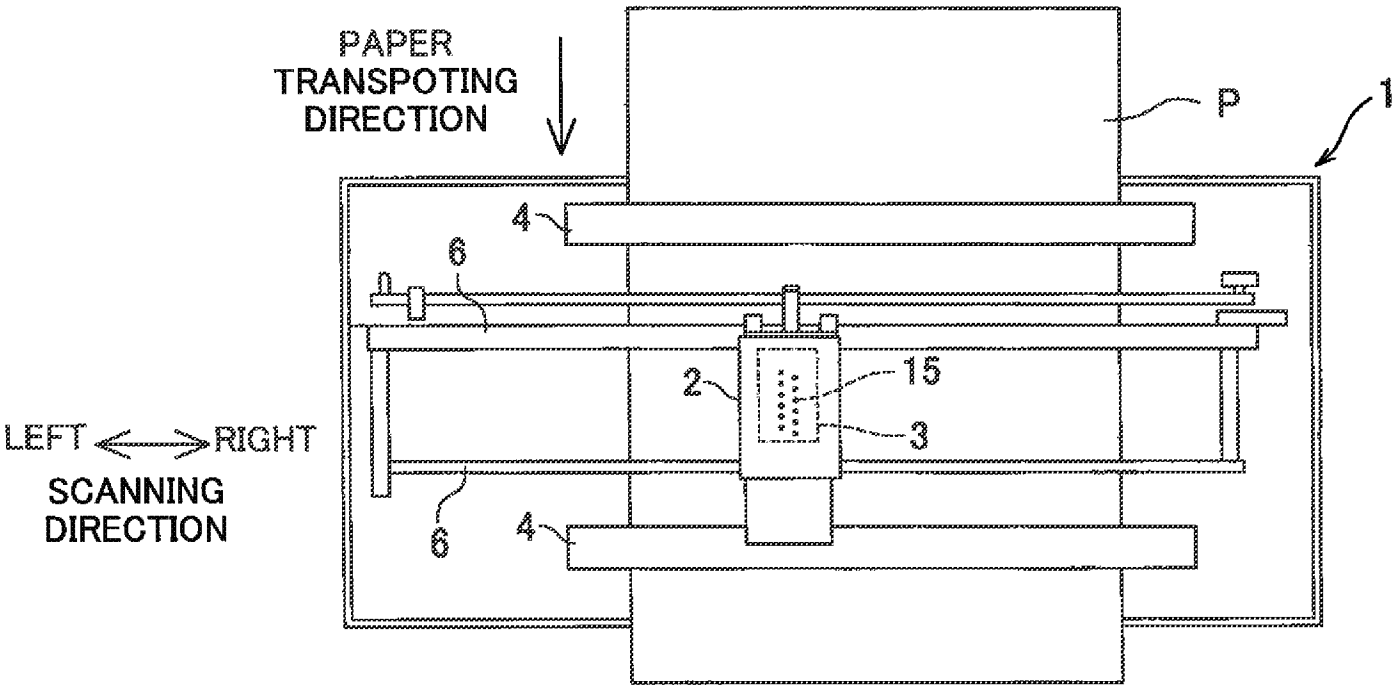
FIG. 1 is a schematic configuration diagram of a printer in accordance with an embodiment of the present teaching.

As shown in FIG. 1, a printer 1 in accordance with this embodiment includes a carriage 2, an ink jetting head 3, paper transport rollers 4, etc. The carriage 2 moves reciprocatingly in a scanning direction along two guide rails 6. Further, the following explanation is carried out regarding the right side and the left side shown in FIG. 1 as the right side and the left side in the scanning direction, respectively.

The ink jetting head 3 is mounted on the carriage 2 to jet ink from a plurality of nozzles 15 formed at its lower surface. The paper transport rollers 4 are arranged on both sides across the carriage 2 in a paper feeding direction perpendicular to the scanning direction to transport recording paper P in the paper feeding direction, Then, the printer 1 carries out printing on the recording paper P by jetting the ink from the ink jetting head 3 moving reciprocatingly along with the carriage 2 in the scanning direction while the paper transport rollers 4 are transporting the recording paper P in the paper feeding direction. Further, the paper transport rollers 4 discharge the recording paper P finished with printing in the paper feeding direction.

Figure 2:
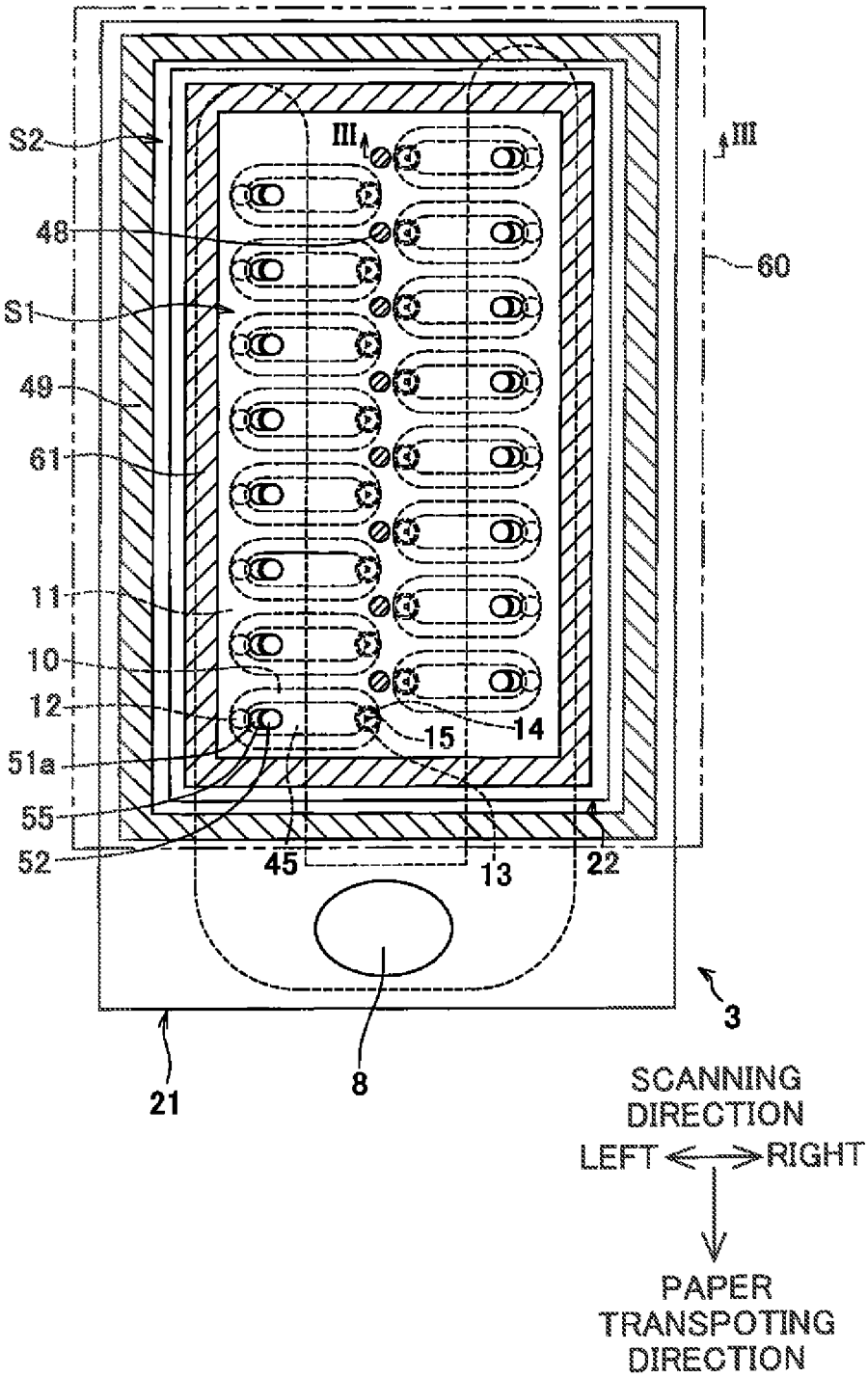
FIG. 2 is a plan view of an ink jetting head of the printer of FIG. 1.
Figure 3:
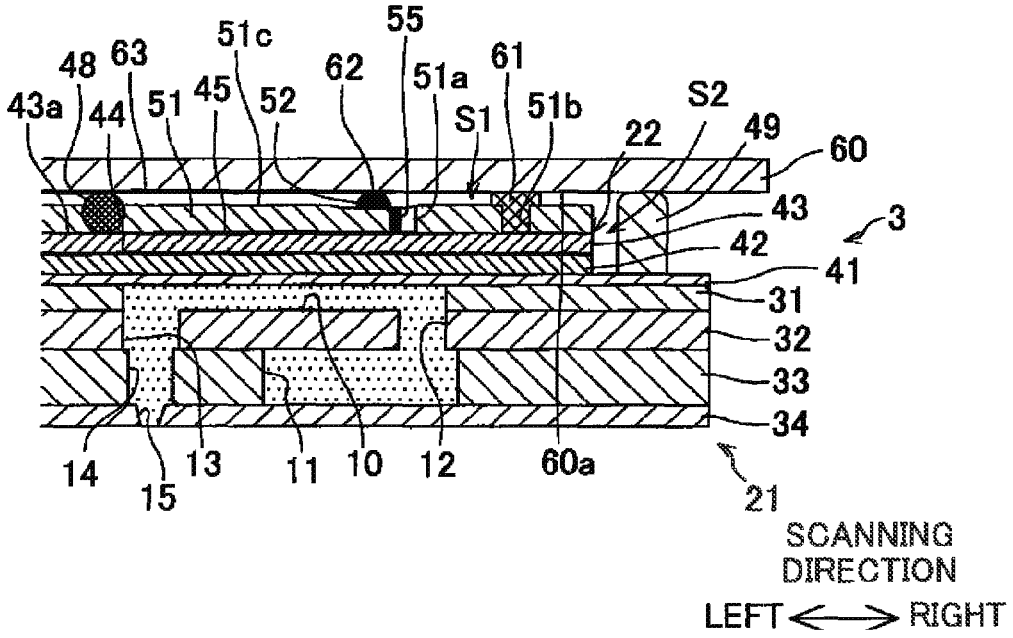
FIG. 3 is a cross-sectional view along the line of FIG. 2.

Next, the ink jetting head 3 will be explained. As shown in FIGS. 2 and 3, the ink jetting head 3 includes a channel unit 21 having ink channels wherein there are formed the nozzles 15 and aftermentioned pressure chambers 10 in communication with the nozzles 15, and a piezoelectric actuator 22 applying a pressure to the ink inside the pressure chambers 10.

The channel unit 21 includes four plates: a cavity plate 31, a base plate 32, a manifold plate 33, and a nozzle plate 34, and these four plates are stacked on each other. The plates 31 to 33 are each made of silicon or a metallic material such as stainless steel or the like. Further, the nozzle plate 34 is made of a synthetic resin material such as polyimide or the like.

The plurality of pressure chambers 10 are formed in the cavity plate 31. Each of the plurality of pressure chambers 10 has an approximately elliptic shape with the scanning direction as its longitudinal direction in planar view. Further, the plurality of pressure chambers 10 are aligned in two rows in the paper feeding direction. A plurality of approximately circular through holes 12 and 13 are formed in such portions of the base plate 32 as facing the two end portions of the plurality of pressure chambers 10 in the longitudinal direction, respectively.

In the manifold plate 33, two manifold channels 11 are formed. The two manifold channels 11 extend in the paper feeding direction to correspond to every row of the pressure chambers 10, and face approximately half of the pressure chambers 10 on the side of the through holes 12 in the scanning direction, respectively. Further, the two manifold channels 11 are connected with each other at the end portion on the downstream side in the paper feeding direction. Then, the ink is supplied to the two manifold channels 11 from an ink supply port 8 provided in the connected portion of the manifold channels 11. Further, a plurality of approximately circular through holes 14 are formed in such portions of the manifold plate 33 as facing the plurality of through holes 13. The plurality of nozzles 15 are formed in such portions of the nozzle plate 34 as facing the plurality of through holes 14.

Then, in the channel unit 21, the manifold channels 11 communicate with the pressure chambers 10 via the through holes 12, while the pressure chambers 10 communicate with the nozzles 15 via the through holes 13 and 14. By virtue of this, in the channel unit 21, a plurality of individual ink channels are formed from the exits of the manifold channels 11 through the pressure chambers 10 to the nozzles 15.

The piezoelectric actuator 22 includes an ink separation layer 41, piezoelectric layers 42 and 43, a common electrode 44, a plurality of individual electrodes 45, etc. The ink separation layer 41 is formed by a metallic material such as stainless steel or the like, and joined with the upper surface of the cavity plate 31 to cover the plurality of pressure chambers 10. The ink separation layer 41 serves to prevent the ink inside the pressure chambers 10 from contact with the piezoelectric layer 42.

The piezoelectric layer 42 is formed by a piezoelectric material which is composed primarily of lead zirconate titanate, i.e., a mixed crystal of lead titanate and lead zirconate, and extends continuously on the upper surface of the ink separation layer 41 across the plurality of pressure chambers 10. The piezoelectric layer 43 is formed of the same piezoelectric material as the piezoelectric layer 42, and extends continuously on the upper surface of the piezoelectric layer 42 over the entire area.

The common electrode 44 is arranged between the piezoelectric layer 42 and the piezoelectric layer 43 through almost the entire area. The common electrode 44 is constantly kept at the ground potential by an unshown driver IC mounted on an aftermentioned substrate 60. Each of the plurality of individual electrodes 45 has a planar shape of an approximate ellipse which is one-size smaller than that of the pressure chambers 10. The plurality of individual electrodes 45 are arranged on an upper surface 43*a* of the piezoelectric layer 43 to face the approximately central portions of the plurality of pressure chambers 10, respectively. Further, the unshown driver IC mounted on the aftermentioned substrate 60 selectively applies either the ground potential or a predetermined drive potential to the plurality of individual electrodes 45, respectively.

Further, corresponding to such arrangement of the common electrode 44 and individual electrodes 45, the piezoelectric layer 43 is polarized in its thickness direction in the portions sandwiched by the common electrode 44 and the individual electrodes 45.

Here, an explanation will be given about a method of driving the piezoelectric actuator 22 to jet the ink from the nozzles 15. In the ink jetting head 3, the plurality of individual electrodes 45 are kept at the ground potential in advance. In order to jet the ink from a certain nozzle 15, the potential of the individual electrode 45 corresponding to this certain nozzle 15 is switched to the predetermined drive potential. Thus, due to a potential difference between the common electrode 44 and the individual electrode 45, an electric field is generated in the portion of the piezoelectric layer 43 sandwiched by the individual electrode 45 and the common electrode 44 in a thickness direction parallel to the polarization direction of the piezoelectric layer 43. By virtue of this, this portion of the piezoelectric layer 43 contracts in its planar direction perpendicular to the polarization direction, thereby deforming the piezoelectric layers 42 and 43, and the ink separation layer 41 in their portions facing the corresponding pressure chamber 10 to project toward the pressure chamber 10. As a result, the pressure chamber 10 undergoes a volume decrease so as to increase the pressure of the ink inside the pressure chamber 10, thereby jetting the ink from the nozzle 15 in communication with the pressure chamber 10.

Further, an elastic deformation layer 51 is arranged over the upper surface 43*a* of the piezoelectric layer 43 on which the plurality of individual electrodes 45 are arranged. The elastic deformation layer 51 is formed by, for example, a nonconductive material with a smaller elastic coefficient than the piezoelectric layer 43 and the aftermentioned substrate 60 such as urethane, silicon rubber or the like, and extends over almost the entire area of the upper surface 43*a* of the piezoelectric layer 43. Further, through holes 51*a* are formed in such portions of the elastic deformation layer 51 as facing the end portions of the plurality of individual electrodes 45 on the side of the through holes 12 in the scanning direction. On an upper surface 51*c* of the elastic deformation layer 51, a plurality of bumps 52 are arranged in the portions adjacent to the plurality of through holes 51*a* to correspond to the plurality of individual electrodes 45. The mutually corresponding individual electrodes 45 and bumps 52 are electrically connected via conductive media 55 which are formed by a metallic material or the like and arranged inside the through holes 51*a*. Further, another through hole 51*b* is formed in the elastic deformation layer 51. In planar view, the through hole 51*b* extends in an approximately rectangular shape to encircle the plurality of pressure chambers 10 through the entire periphery.

Further, a reinforcement frame 49 is arranged on the upper surface of the is separation layer 41. The reinforcement frame 49 has a frame shape of an approximate rectangle in planar view, and is arranged on the upper surface of the ink separation layer 41 to encircle the piezoelectric layers 42 and 43 through the entire periphery. By virtue of this, the plurality of individual electrodes 45 and the plurality of bumps 52 are enclosed by the reinforcement frame 49 in planar view. Further, the reinforcement frame 49 projects upward above the upper surface of the elastic deformation layer 51. Then, the ink jetting head 3 is reinforced in terms of rigidity by the reinforcement frame 49 arranged on the upper surface of the ink separation layer 41.

Further, a plurality of spherical members 48 are arranged in the upper surface 51*c* of the elastic deformation layer 51. The spherical members 48 are aligned in the paper feeding direction, and arranged in the portions which face the portion of the channel unit 21 between the aforementioned two rows of the pressure chambers 10. The spherical members 48 are formed by a harder material than the elastic deformation layer 51 such as a synthetic resin material. Except for the upper end portions of the spherical members 48, by being embedded in the elastic deformation layer 51, the spherical members 48 are fixed in the elastic deformation layer 51 while their lower ends are in contact with the upper surface 43*a* of the piezoelectric layer 43. Further, the upper end portions of the spherical members 48 project upward from the upper surface 51*c* of the elastic deformation layer 51 so as to be positioned almost as high as the upper end of the reinforcement frame 49.

Above the elastic deformation layer 51, the substrate 60, which is provided with the driver IC and the like, is arranged to output a drive signal to the ink jetting head. The substrate 60 is, for example, a rigid substrate with a greater elastic coefficient than the elastic deformation layer 51 such as a glass epoxy substrate, an alumina substrate or the like. On a lower surface 60*a* of the substrate 60, a plurality of connection terminals 62 are arranged in the portions facing the plurality of bumps 52. Further, on the substrate 60, a plurality of wires 63 are arranged to connect the plurality of connection terminals 62 with the unshown driver IC. Here, the driver IC is, for example, mounted on the upper surface of the substrate 60 in an area not appearing in FIG. 3, and the lower surface 60*a* of the substrate 60 is connected with the driver IC mounted on the upper surface of the substrate 60 via a through hole or the like formed in the substrate 60. In this manner, if the substrate 60 is a hard substrate, then it is possible to mount the driver IC on the upper surface of the substrate 60. Further, the wires 63 may be arranged on the lower surface 60*a* of the substrate 60 as shown in FIG. 3, or arranged in a different manner from that shown in FIG. 3 such as inside or on the upper surface of the substrate 60.

Further, a fixing member 61 fixes the substrate 60 to the piezoelectric actuator 22. To explain in more detail, the fixing member 61 is formed by an adhesive which contracts when hardening such as a UV-curable adhesive, heat-curable epoxy adhesive, or the like. Then, the fixing member 61 is arranged in the portion overlapping the through hole 51*b* between the piezoelectric actuator 22 and the substrate 60 and, via the through hole 51*b*, extends down to the upper surface 43*a* of the piezoelectric layer 43. By virtue of this, the fixing member 61 contacts both the upper surface 43*a* of the piezoelectric layer 43 and the lower surface 60*a* of the substrate 60, and thus fixes the piezoelectric layer 43 and the substrate 60 to each other.

Further, the fixing member 61 is arranged in the above manner to overlap the through hole 51*b*. Therefore, it encircles the plurality of pressure chambers 10 through the entire periphery in planar view. Further, the fixing member 61 arranged in the above manner faces an area on the left of the pressure chambers 10 aligned on the left side in the scanning direction, and another area on the right of the pressure chambers 10 aligned on the right side in the scanning direction, in the channel unit 21. That is, the fixing member 61 faces the areas adjacent to the respective pressure chambers 10 on the end portion sides of the channel unit 21 where the bumps 52 are formed.

Then, the piezoelectric layer 43 and substrate 60, which are fixed to each other by the fixing member 61, have a tendency to draw near to each other due to the contraction force of the fixing member 61 when hardening. Therefore, being sandwiched by the piezoelectric layer 43 and the substrate 60, the portions of the elastic deformation layer 51, on which the bumps 52 are arranged and which are arranged between the piezoelectric layer 43 and the substrate 60, are undergoing elastic deformation. Further, due to the reaction force arising from the tendency for the above elastic-deformed portions of the elastic deformation layer 51 to restore the previous state before elastic deformation, the bumps 52 arranged on their upper surfaces are caused to contact with the connection terminals 62 arranged on the lower surface 60*a* of the substrate 60. By virtue of this, the bumps 52 are connected with the connection terminals 62. Further, at this time, the substrate 60 contacts with the upper ends of the spherical members 48 and reinforcement frame 49.

Further, because the fixing member 61 fixes the substrate 60 to the piezoelectric actuator 22, an enclosed space S1 is formed by the space enclosed by the piezoelectric layer 43, the fixing member 61, and the substrate 60. By virtue of this, the plurality of bumps 52, the plurality of connection terminals 62, and the like are arranged inside the enclosed space S1. Further, an enclosed space S2 is formed by the space enclosed by the ink jetting head 3, the reinforcement frame 49, and the substrate 60. Thus, the abovementioned enclosed space S1 is arranged inside the enclosed space S2. As a result, the plurality of bumps 52, the plurality of connection terminals 62, and the like are arranged inside the enclosed space S2.

Next, using FIGS. 4A to 4D, an explanation will be given about a procedure of connecting the substrate 60 to the ink jetting head 3 in production of the printer 1. Further, at the stage of connecting the substrate 60 to the ink jetting head 3, it is possible to appropriately change the orientations of the ink jetting head 3 and the substrate 60 according to the orientation of the production equipment, etc. For the sake of convenience, however, FIGS. 4A to 4D show a direction in the scanning direction as the scanning direction when the ink jetting head 3 and substrate 60 are assembled to the printer 1.

Figure 4A:
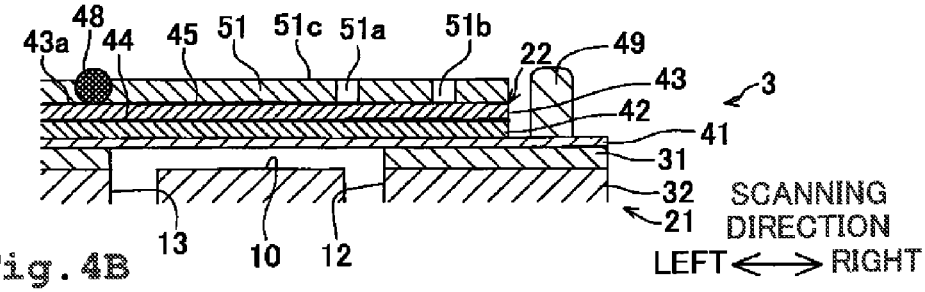
FIGS. 4A to 4D show a procedure of connecting a substrate to the ink jetting head.

In order to connect the substrate 60 to the ink jetting head 3, first, as shown in FIG. 4A, the elastic deformation layer 51 formed with the through holes 51*a* and 51*b* is formed on the upper surface of the fabricated ink jetting head 3. In particular, for example, the elastic deformation layer 51 is formed by coating the material for the elastic deformation layer 51 before crosslink on the upper surface of the piezoelectric layer 43, and then cross-linking the coated material to harden the same. At this time, the spherical members 48 are embedded through the upper surface 51*c* into the elastic deformation layer 51 before being hardened. By virtue of this, when the elastic deformation layer 51 is hardened, the spherical members 48 are fixed in the elastic deformation layer 51, and positioned at the fixed places.

Figure 4B:
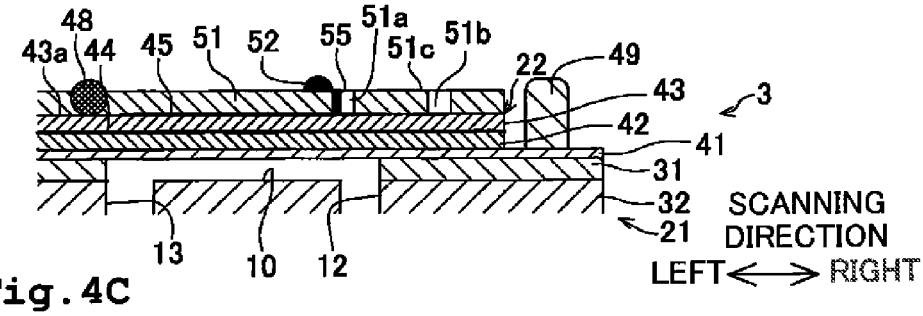

Next, as shown in FIG. 4B, the bumps 52 and the individual electrodes 45 are electrically conducted by forming the bumps 52 on the upper surface of the elastic deformation layer 51 while forming the conductive media 55 inside the through holes 51*a*. Here, it is possible to form the elastic deformation layer 51 and bumps 52 by a publicly known method such as, for example, an ink jet method adapted to drop the materials of forming the same, or the like.

Figure 4C:
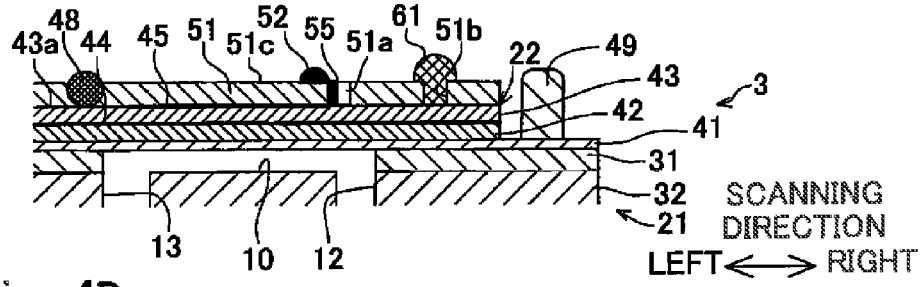

Next, as shown in FIG. 4C, the fixing member 61 is formed by applying the adhesive to the portion of the upper surface of the elastic deformation layer 51 over the through hole 51*b*.

Figure 4D:
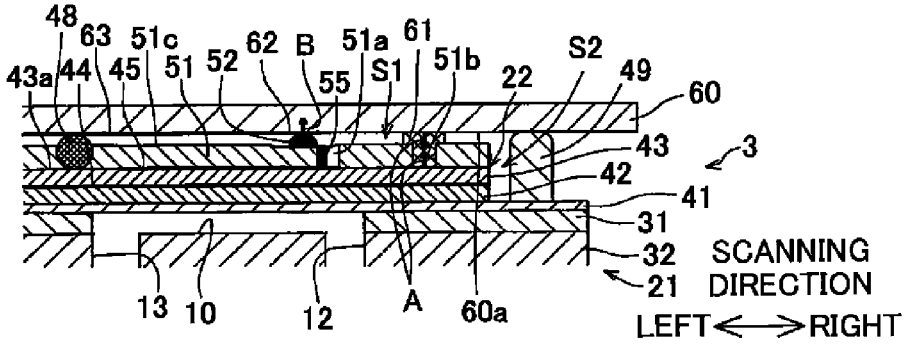

Next, as shown in FIG. 4D, the substrate 60 is disposed above the piezoelectric actuator 22 where the elastic deformation layer 51 and the fixing member 61 have been formed. Then, the piezoelectric layer 43 and the substrate 60 are fixed to each other by hardening the fixing member 61. In this case, it is desirable for the fixing member 61 to be heat-curable. However, for the fixing member 61 to be heat-curable is not a necessary requirement, but merely an exemplification. At this time, as shown by the arrows A, the fixing member 61 contracts due to the hardening. Then, the contraction force of the fixing member 61 causes the piezoelectric actuator 22 and the substrate 60 to move in the directions of approaching each other.

By virtue of this, the portions of the elastic deformation layer 51, on which the bumps 52 are arranged and which are arranged between the piezoelectric layer 43 and the substrate 60, are pressed upward by the piezoelectric layer 43 but pressed downward by the substrate 60 so as to undergo elastic deformation. Further, due to the reaction force arising from the tendency for those elastic-deformed portions of the elastic deformation layer 51 to restore the previous state before elastic deformation, as shown by the arrow B, the humps 52 are caused to contact with the connection terminals 62 arranged on the substrate 60. By virtue of this, the bumps 52 are connected with the connection terminals 62. At this time, however, as the piezoelectric actuator 22 and the substrate 60 have been drawn near to some extent, the lower surface 60*a* of the substrate 60 contacts with the upper ends of the spherical members 48 and reinforcement frame 49, thereby restraining the substrate 60 from drawing nearer to the piezoelectric actuator 22. Therefore, the substrate 60 will not be drawn near to the piezoelectric actuator 22 beyond the position of contact between the lower surface 60*a* of the substrate 60 and the upper end of the reinforcement frame 49.

According to the embodiment explained above, when connecting the piezoelectric actuator 22 to the substrate 60, due to the contraction force of the fixing member 61 fixing the piezoelectric actuator 22 and the substrate 60 to each other, the piezoelectric actuator 22 and the substrate 60 move in the directions of approaching each other. By virtue of this, the elastic deformation layer 51 is sandwiched by the piezoelectric actuator 22 and the substrate 60 to undergo elastic deformation. Further, due to the reaction force arising from the tendency for the elastic deformation layer 51 to restore the previous state before elastic deformation, the bumps 52 are caused to contact with the connection terminals 62 of the substrate 60. Therefore, the adhesion between the bumps 52 and the connection terminals 62 increases, and thus the bumps 52 and the connection terminals 62 are reliably connected.

Here, because of the variation in the thickness of the elastic deformation layer 51 before elastic deformation, the variation in the height of the plurality of bumps 52 themselves, etc., there is generally some variation in the height of the upper ends of the plurality of bumps 52. In this embodiment, however, the elastic deformation layer 51 undergoes elastic deformation, thereby absorbing the variation in the height of the upper ends of the bumps 52. By virtue of this, it is possible to reliably connect the plurality of bumps 52 with the corresponding connection terminals 62.

Further, on this occasion, because the fixing member 61 is arranged to encircle the plurality of pressure chambers 10 through the entire periphery in planar view, the plurality of bumps 52 and the plurality of connection terminals 62 are arranged within the area encircled by the fixing member 61 in planar view. By virtue of this, the contraction force of the fixing member 61 is applied evenly to the portions of the elastic deformation layer 51 on which the respective bumps 52 are formed, and thus the portions of the elastic deformation layer 51 on which the respective bumps 52 are formed evenly undergo elastic deformation. Therefore, it is possible to reliably connect the plurality of bumps 52 with the corresponding connection terminals 62.

Further, in this embodiment, the fixing member 61 is arranged to encircle the plurality of pressure chambers 10 through the entire periphery in planar view. Thereby, it is arranged to face the area adjacent to the respective pressure chambers 10 in the channel unit 21 on the sides of the end portions where the bumps 52 are formed. By virtue of this, the fixing member 61 is positioned in the vicinity of the respective bumps 52. Therefore, when the fixing member 61 contracts, it is possible to reliably cause the elastic deformation layer 51 to undergo elastic deformation in the portions on which the respective bumps 52 are arranged.

Further, in this embodiment, due to the reaction force arising from the tendency for the elastic deformation layer 51 to restore the previous state before elastic deformation, the bumps 52 contact with the connection terminals 62 of the substrate 60. By virtue of this, because the bumps 52 are connected with the connection terminals 62, after conjoining the piezoelectric layer 43 and the substrate 60, even if some external force is applied to the substrate 60, the connection terminals 62 are still less likely to be detached from the bumps 52.

Further, in this embodiment, because the fixing member 61 is an adhesive which contracts when hardening, it is possible to simply form the fixing member 61.

Further, in this embodiment, the through hole 51*b* is formed in the elastic deformation layer 51. Therefore, there is a portion of the upper surface 43*a* of the piezoelectric layer 43 on which the elastic deformation layer 51 is not arranged, and the fixing member 61 fixes this portion of the piezoelectric layer 43 and the substrate 60 to each other. Here, the elastic deformation layer 51 is less strong than the piezoelectric layer 43. Therefore, if supposedly the substrate 60 is fixed only to the elastic deformation layer 51, then in order to increase the conjunction force between the piezoelectric actuator 22 and the substrate 60, it is necessary to arrange the fixing member 61 through a wide area between the elastic deformation layer 51 and the substrate 60.

In contrast to such case, in this embodiment as described above, the fixing member 61 mutually fixes the substrate 60, and the piezoelectric layer 43 which is stronger than the elastic deformation layer 51. Therefore, even though the fixing member 61 is not arranged through so wide an area between the piezoelectric actuator 22 and the substrate 60, it is still possible to increase the conjunction strength between the piezoelectric actuator 22 and the substrate 60.

Further, in this embodiment as described above, the plurality of bumps 52, the plurality of connection terminals 62 and the like are arranged inside the enclosed spaces S1 and S2. Therefore, when humidity increases around the apparatus, etc., no moisture may come into these spaces. Thus, it is possible to prevent the bumps 52 from so-called migration, i.e. electrical conduction with each other via moisture, as well as from getting rusted, etc., by the moisture.

Further, because the contraction amount of an adhesive in solidification varies with the quantity and the like of the applied adhesive, it is generally difficult to control the contraction amount of the fixing member 61 made of an adhesive. In contrast to such case, in this embodiment as described above, the substrate 60 will never be drawn near to the piezoelectric actuator 22 beyond the position of contact between the lower surface 60*a* of the substrate 60 and the upper ends of the spherical members 48 and reinforcement frame 49. Therefore, when the fixing member 61 contracts, it is possible to prevent the piezoelectric actuator 22 and the substrate 60 from drawing too near to each other and thus causing the elastic deformation layer 51 to undergo excessive elastic deformation.

Further, in this embodiment, the elastic deformation layer 51 is arranged over the upper surface 43*a* of the piezoelectric layer 43 in the portion facing the pressure chambers 10. Then, the bumps 52 are arranged on the upper surface of the elastic deformation layer 51 in the portions facing the pressure chambers 10. Therefore, compared with a case where the bumps 52 are arranged on the upper surface of the elastic deformation layer 51 in some portions not facing the pressure chambers 10, it is possible to make the ink jetting head 3 smaller.

Here, as the bumps 52 are arranged on the upper surface of the elastic deformation layer 51 in the portions facing the pressure chambers 10, when driving the piezoelectric actuator 22, the bumps 52 connected with the connection terminals 62 of the substrate 60 are liable to inhibit the deformation of the portions, facing the pressure chambers 10, of the piezoelectric layers 42 and 43, and ink separation layer 41. To address this problem, in this embodiment, the elastic deformation layer 51 arranged between the piezoelectric layer 43 and the bumps 52 is capable of elastic deformation and has a small elastic coefficient. Therefore, even though the bumps 52 are arranged to face the pressure chambers 10, when driving the piezoelectric actuator 22, it is still possible to restrain inhibition of deformation of the portions, facing the pressure chambers 10, of the piezoelectric layers 42 and 43, and ink separation layer 41. Further, in this embodiment, the bumps 52 are arranged on the upper surface of the elastic deformation layer 51 in the portions facing end portions of the pressure chambers 10 in the longitudinal direction. Therefore, compared with a case where the bumps 52 are arranged on the elastic deformation layer 51 in portions facing the central portions of the pressure chambers 10, when driving the piezoelectric actuator 22, it is possible to further restrain inhibition of deformation of the piezoelectric layers 42 and 43, and ink separation layer 41.

Further, in this embodiment, the fixing member 61 is arranged not to face the plurality of pressure chambers 10 but to encircle same in planar view. By virtue of this, when driving the piezoelectric actuator 22, it is possible to restrain the fixing member 61 from inhibiting the deformation of the piezoelectric layers 42 and 43, and ink separation layer 41.

Further, in this embodiment, the ink jetting head 3 corresponds to the liquid jetting head and structure according to the present teaching. Further, the part formed by connecting the ink jetting head 3 and the substrate 60 corresponds to the liquid jetting apparatus and connecting structure of substrate according to the present teaching. Further, the part combining the plates 31 to 33 corresponds to the channel member according to the present teaching. Further, the spherical members 48 and reinforcement frame 49 correspond to the spacer according to the present teaching. The upper surface 43*a* of the piezoelectric layer 43 corresponds to the surface of the piezoelectric actuator on the opposite side to the channel unit according to the present teaching. Further, the bumps 52 correspond to the head-side contact points according to the present teaching. Further, the upper surface 51*c* of the elastic deformation layer 51 corresponds to the surface of the elastic deformation layer on the opposite side to the piezoelectric actuator according to the present teaching. Further, the lower surface 60*a* of the substrate 60 corresponds to the surface of the substrate on the piezoelectric actuator side according to the present teaching. Further, the connection terminals 62 correspond to the substrate-side contact points according to the present teaching. Further, the up-down direction corresponds to the direction in which the liquid jetting head faces the substrate according to the present teaching.

Further, the step shown in FIG. 4A corresponds to the elastic deformation layer formation step according to the present teaching. Further, the step shown in FIG. 4B corresponds to the contact point formation step according to the present teaching. Further, the steps shown in FIGS. 4C and 4D correspond to the fixation step according to the present teaching.

Next, explanations will be made with respect to a number of modifications which apply various changes to the above embodiment. Note that, however, explanations will be omitted as appropriate for the components having similar or equivalent configurations to those in the above embodiment.

Figure 5:
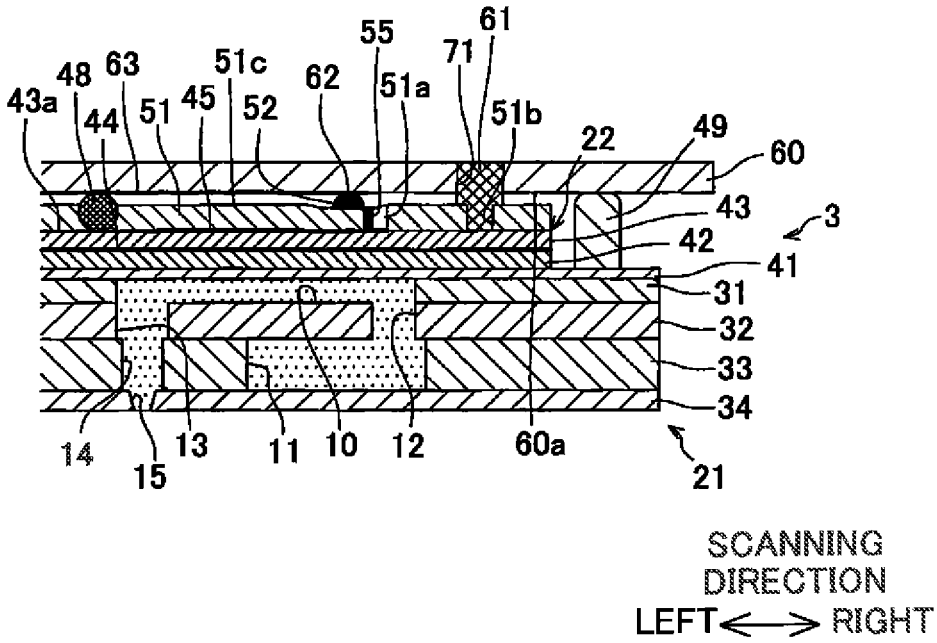
FIG. 5 is a view corresponding to FIG. 3 in accordance with a first modification.

In the above embodiment, when fixing the piezoelectric actuator 22 and the substrate 60 to each other, the substrate 60 is arranged above the piezoelectric actuator 22 after forming the fixing member 61 on the upper surface 43*a* of the piezoelectric layer 43. However, the present teaching is not limited to this. In a first modification as shown in FIG. 5, a through hole 71 is formed in each fixation portion of the substrate 60 to be fixed to the piezoelectric actuator 22. Then, the fixing member 61 penetrates into the through holes 71 to fix the piezoelectric actuator 22 and the substrate 60 to each other.

Figure 6A:
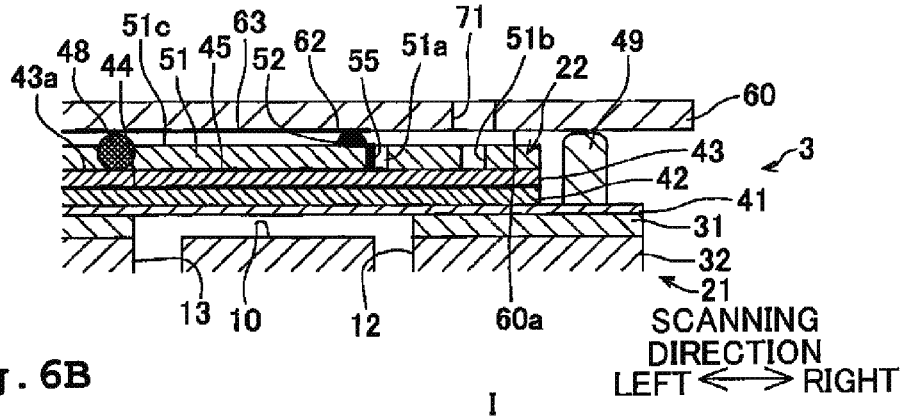
FIGS. 6A to 6C show a procedure of connecting a substrate to an ink jetting head in accordance with the first modification.
Figure 6B:
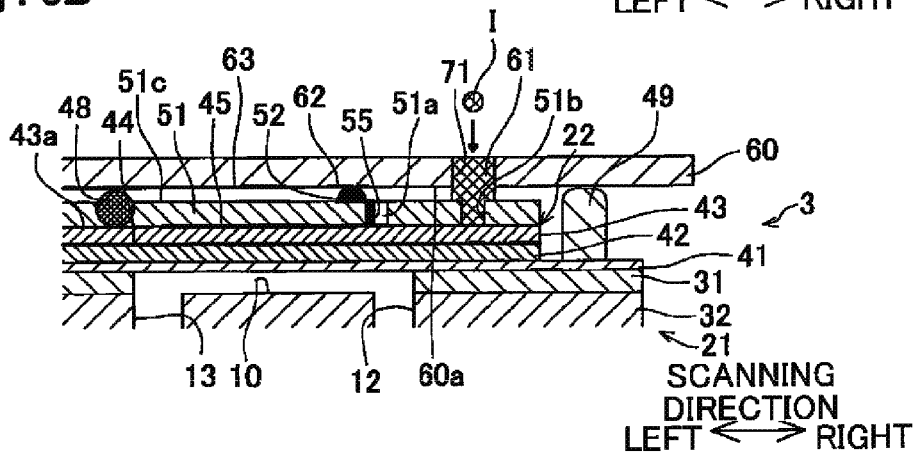
Figure 6C:
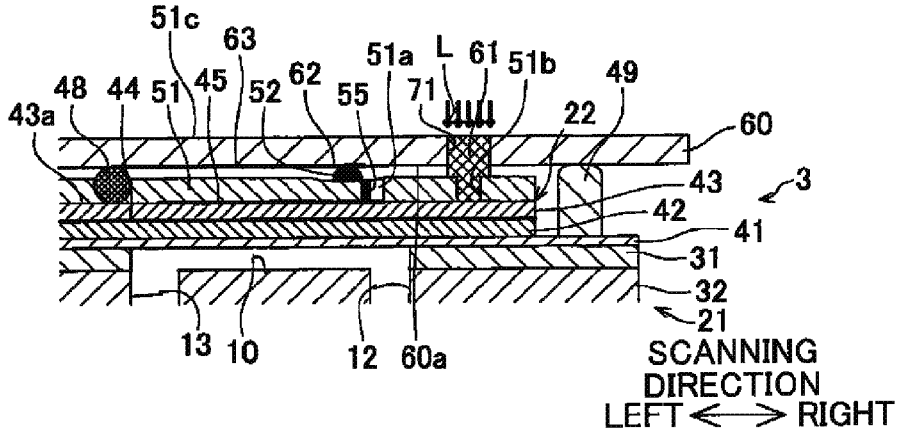

Then, in this case, when connecting the substrate 60 to the piezoelectric actuator 22, as shown in FIG. 4B, the bumps 52 are formed on the upper surface of the elastic deformation layer 51, while the substrate 60 formed with the through holes 71 is arranged above the elastic deformation layer 51, as shown in FIG. 6A, after forming the conductive media 55 to electrically conduct the bumps 52 and the individual electrodes 45. Successively, as shown in FIG. 6B, the ink jet method is used to form the fixing member 61 by dropping a UV-curable adhesive I from above the through holes 71. Next, as shown in FIG. 6C, the fixing member 61 is hardened by irradiation with ultraviolet light L from above the through holes 71.

In this case, the fixing member 61 is formed after arranging the substrate 60 above the piezoelectric actuator 22. Therefore, compared with the case as the above embodiment where the substrate 60 is arranged above the piezoelectric actuator 22 after forming the fixing member 61, it is possible to more easily carry out the position adjustment between the piezoelectric actuator 22 and the substrate 60.

Further, in this case, the fixing member 61 penetrates into the through holes 71 formed in the substrate 60, thereby further increasing the conjunction strength between the piezoelectric actuator 22 and the substrate 60. Further, as described above, it is possible to form the fixing member 61 by dropping the UV-curable adhesive I from above the through holes 71, and the fixing member 61 is hardened by irradiation with the ultraviolet light L from above the through holes 71. Therefore, it is possible to easily form and harden the fixing member 61.

Further, in the first modification, if the elastic deformation layer 51, the bumps 52, and the fixing member 61 are all formed by way of the ink jet method, then it is possible to use one single method to form all those components. By virtue of this, production of the printer 1 becomes simple.

Further, in the first modification, the step shown in FIG. 6A corresponds to the substrate arrangement step according to the present teaching. Further, the step shown in FIG. 6B corresponds to the adhesive formation step according to the present teaching. Further, the step shown in FIG. 6C corresponds to the adhesive hardening step according to the present teaching. Then, the series of steps shown in FIGS. 6A to 6C correspond to the fixation step according to the present teaching.

Here in the first modification, the fixing member 61 is formed by a UV-curable adhesive. However, the fixing member 61 may also be formed by a heat-curable epoxy adhesive. In such case, it is also possible to easily form the fixing member 61 by dropping the adhesive from above the through holes 71.

Figure 7A:
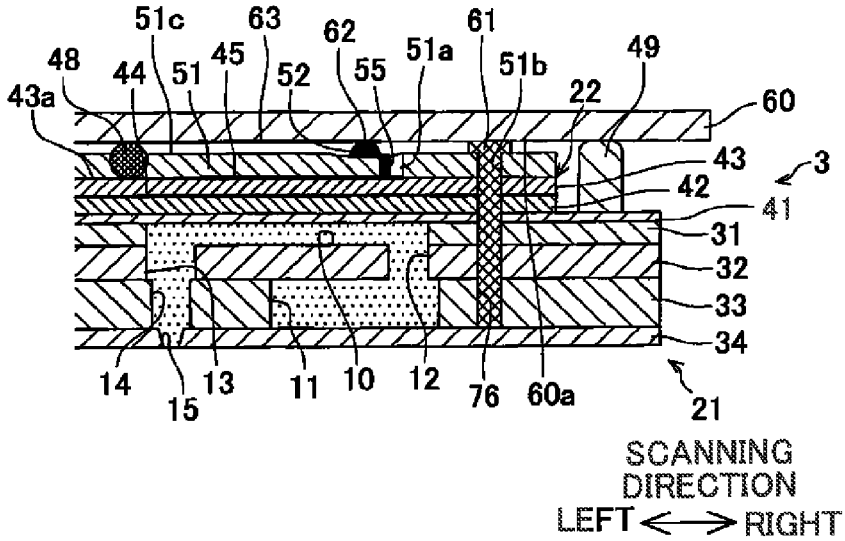
FIG. 7A is a view corresponding to FIG. 3 in accordance with a second modification.

Further, in a second modification, as shown in FIG. 7A, a hole 76 is formed in the portion of the ink jetting head 3 to face each fixation portion of the substrate 60, and to extend through the plates 31 to 33, ink separation layer 41, and piezoelectric layers 42 and 43 in their stacked direction. Then, the fixing member 61 penetrates into the holes 76 to fix the piezoelectric actuator 22 and the substrate 60 to each other. Further, the lower ends of the holes 76 are sealed up by the nozzle plate 34. Here in the second modification, the nozzle plate 34 is formed by a translucent material of synthetic resin.

Figure 7B:
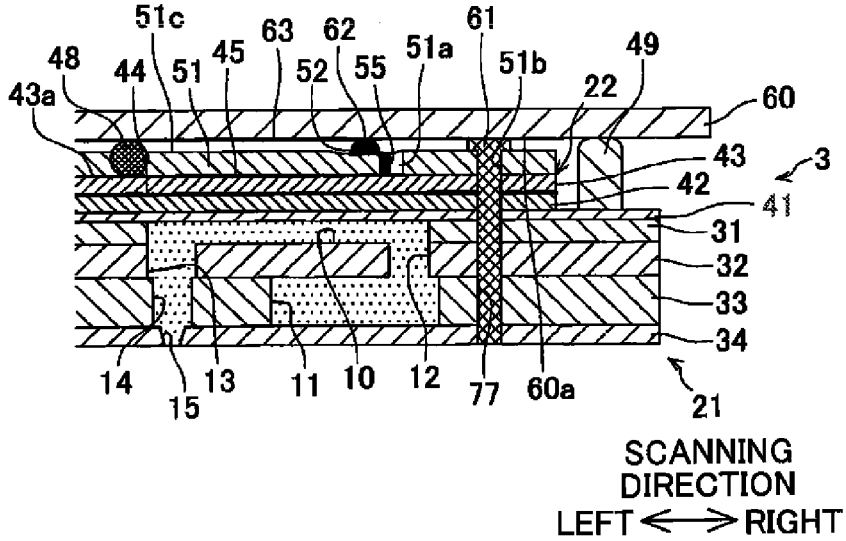
FIG. 7B is a view corresponding to FIG. 3 in accordance with a third modification.

Further, in a third modification, the nozzle plate 34 is formed by the same material as the plates 31 to 33 such as a metallic material or silicon. Then, as shown in FIG. 7B, a hole 77 is formed in the portion of the ink jetting head 3 to face each fixation portion of the substrate 60, and to extend through the plates 31 to 34, ink separation layer 41, and piezoelectric layers 42 and 43 in their stacked direction. Then, the fixing member 61 penetrates into the holes 77 to fix the piezoelectric actuator 22 and the substrate 60 to each other.

In the second and third modifications, because the fixing member 61 penetrates into the holes 76 and 77, it is possible for the fixing member 61 to further increase the conjunction strength between the piezoelectric actuator 22 and the substrate 60.

Further, in the second modification, the lower ends of the holes 76 are sealed up by the nozzle plate 34. However, because the nozzle plate 34 is fanned by a translucent material, it is possible to confirm whether or not the fixing member 61 is formed normally in the holes 76 by visual inspection and the like through the nozzle plate 34.

On the other hand, in the third modification, because the holes 77 vertically penetrate through the channel unit 21, it is possible to confirm whether or not the fixing member 61 is formed normally in the holes 77 by visual inspection and the like from below the channel unit 21.

Further, if the nozzle plate 34 is formed by a synthetic resin material, then in order to improve its abrasion resistance, a plate made of a metallic material may be further joined to the lower surface of the nozzle plate 34. In the second modification, if such a plate is provided, then it is preferable to form a through hole in each portion of this plate overlapping the holes 76.

It is possible to appropriately combine the above embodiment and modifications. The same is true for the aforementioned modifications. For example, it is also possible to form both the through holes 71 of the first modification and the holes 76 of the second modification, and to let the fixing member 61 penetrate into both the through holes 71 and the holes 76. Alternatively, it is also possible to form both the through holes 71 of the first modification and the holes 77 of the third modification, and to let the fixing member 61 penetrate into both the through holes 71 and the holes 77. In these cases, the conjunction strength further increases between the piezoelectric actuator 22 and the substrate 60.

Further, in the above embodiment, the elastic deformation layer 51 is made of a nonconductive material, and the individual electrodes 45 arranged on the upper surface 43*a* of the piezoelectric layer 43 are in electrical conduction with the bumps 52 arranged on the upper surface of the elastic deformation layer 51 via the conductive media 55 arranged inside the through holes 51*a* of the elastic deformation layer 51. However, the present teaching is not limited to this.

Figure 8A:
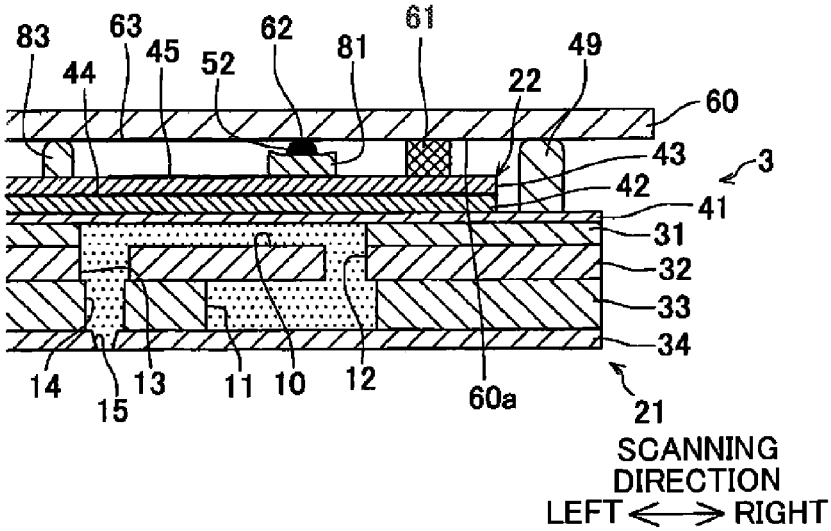
FIG. 8A is a view corresponding to FIG. 3 in accordance with a fourth modification.

In a fourth modification, as shown in FIG. 8A, conductive double-faced tapes 81 are arranged, respectively, over the portions of the upper surface 43*a* of the piezoelectric layer 43 on which the individual electrodes 45 are arranged, to face (and lie on) the portions of the respective individual electrodes 45 including the right end portions in the scanning direction. Here, the conductive double-faced tapes 81 are formed by mixing a conductive material into a base material made of urethane or the like. Then, the bumps 52 are arranged on the upper surfaces of the conductive double-faced tapes 81, respectively. By virtue of this, the individual electrodes 45 are in electrical conduction with the bumps 52 via the conductive double-faced tapes 81.

In this case, just by arranging the bumps 52 on the upper surface of the conductive double-faced tapes 81, it is possible to electrically conduct the individual electrodes 45 and the bumps 52. Further, in the fourth modification, the conductive double-faced tapes 81 correspond to the elastic deformation layer according to the present teaching. Thus, the elastic deformation layer formed by the conductive double-faced tapes 81 is segmented according to each of the plurality of pressure chambers 10.

Figure 8B:
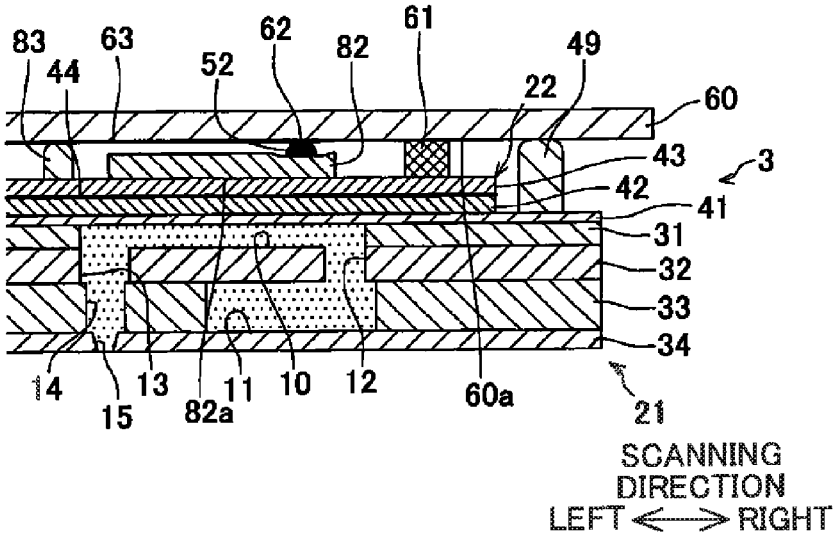
FIG. 8B is a view corresponding to FIG. 3 in accordance with a fifth modification.

Further, in a fifth modification, as shown in FIG. 8B, the individual electrodes 45 (see FIG. 3) are not arranged on the upper surface 43*a* of the piezoelectric layer 43. Then, conductive polymer layers 82, which each have almost the same planar shape of an approximate ellipse as the individual electrodes 45, are each arranged on the upper surface 43*a* of the piezoelectric layer 43 without having the individual electrodes 45 arranged, in the portion facing the each approximately central portion of the pressure chambers 10. Then, the bumps 52 are arranged on the upper surfaces of the conductive polymer layers 82, respectively.

In this case, the conductive polymer layers 82 correspond to the elastic deformation layer according to the present teaching. Thus, the elastic deformation layer formed by the conductive polymer layers 82 is segmented according to each of the plurality of pressure chambers 10. Further, in this case, lower surfaces 82*a* of the conductive polymer layers 82, i.e. the junction surfaces with the piezoelectric layer 43, function as the individual electrodes. Therefore, by arranging the conductive polymer layers 82 on the upper surface 43*a* of the piezoelectric layer 43, it is possible to form the elastic deformation layer and the individual electrodes at one time. Further, in this case, just by arranging the bumps 52 on the upper surfaces of the conductive polymer layers 82, electrical connection is established between the bumps 52, and the individual electrodes formed by the lower surfaces 82*a* of the conductive polymer layers 82.

Here in the fourth and fifth modifications, because the elastic deformation layer 51 is not arranged on the upper surface of the piezoelectric layer 43 in the portion facing the part between the two rows of the pressure chambers 10 of the channel unit 21, the spherical members 48 (see FIG. 3) cannot be arranged. Therefore, in the fourth and fifth modifications, a spacer 83 projecting upward from the upper surface 43*a* of the piezoelectric layer 43 is arranged on the upper surface of the piezoelectric layer 43 in the portion facing the part between the two rows of the pressure chambers 10 of the channel unit 21.

Further, as in the above embodiment and the like, even though the elastic deformation layer 51 is arranged on the upper surface of the piezoelectric layer 43 in the portion facing the part between the two rows of the pressure chambers 10 of the channel unit 21, the spacer 83 may still be arranged instead of the spherical members 48. In such cases, a through hole may be formed in the portion of the elastic deformation layer 51 overlapping the spacer 83 to let the spacer 83 extend through this through hole down to the piezoelectric layer 43.

Figure 9A:
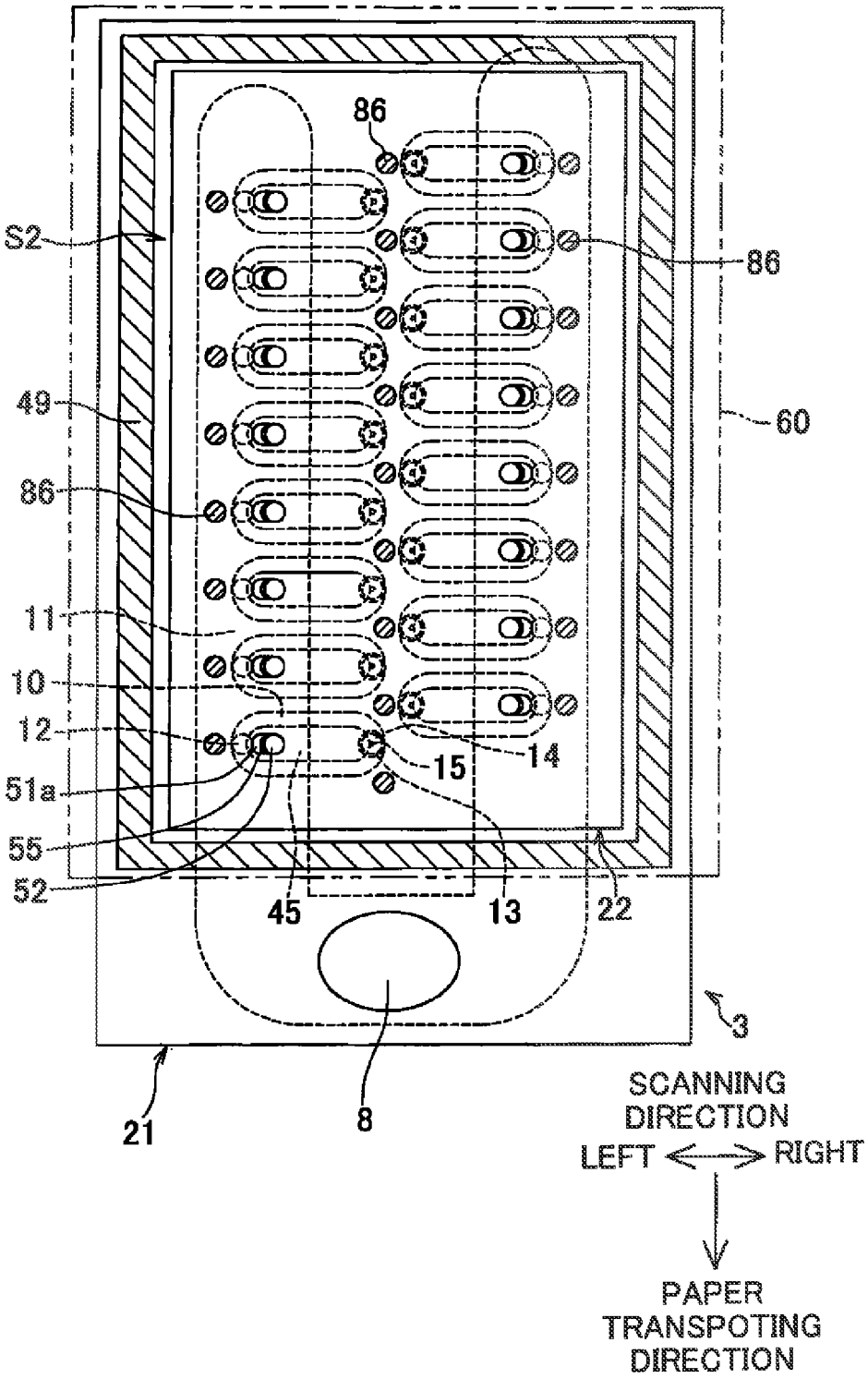
FIG. 9A is a view corresponding to FIG. 2 in accordance with a sixth modification.

Further, in the above embodiment, the fixing member 61 extends to encircle the area where the plurality of bumps 52 are arranged through the entire periphery in planar view. However, the present teaching is not limited to this. In as sixth modification, as shown in FIG. 9A, a plurality of fixing members 86 are scattered on the upper surface 43*a* of the piezoelectric layer 43, in the portion facing the area on the left of the plurality of pressure chambers 10 arranged on the left side in the scanning direction, in the portion facing the area on the right of the plurality of pressure chambers 10 arranged on the right side in the scanning direction, and in the portion facing the area where the spherical members 48 are arranged in the above embodiment between the two rows of the aligned pressure chambers 10. By virtue of this, the plurality of fixing members 86 are arranged between the plurality of bumps 52 in planar view.

In this case, because the contraction force of the plurality of fixing members 86 is applied evenly to the portions of the piezoelectric actuator 22 and substrate 60 facing the areas where the plurality of bumps 52 are arranged, the elastic deformation layer 51 undergoes elastic deformation evenly. By virtue of this, the plurality of bumps 52 are reliably connected with the corresponding connection terminals 62.

Further, in this case, the fixing members 86 are also arranged to face the areas of the respective pressure chambers 10 in the channel unit 21, adjacent to the end portion side on which the bumps 52 are formed. By virtue of this, the fixing members 86 are positioned in the vicinity of the bumps 52, respectively. Therefore, when the fixing members 86 contract, it is possible to reliably cause the elastic deformation layer 51 to undergo elastic deformation in the portions on which the respective bumps 52 are arranged.

Further, in this case, the enclosed space S1 of the above embodiment is not formed. However, the enclosed space S2 is formed, and the plurality of bumps 52, the plurality of connection terminals 62, and the like are arranged inside the enclosed space S2. Therefore, it is possible to prevent the bumps 52 from the migration, as well as from getting rusted, etc., by moisture.

Figure 9B:
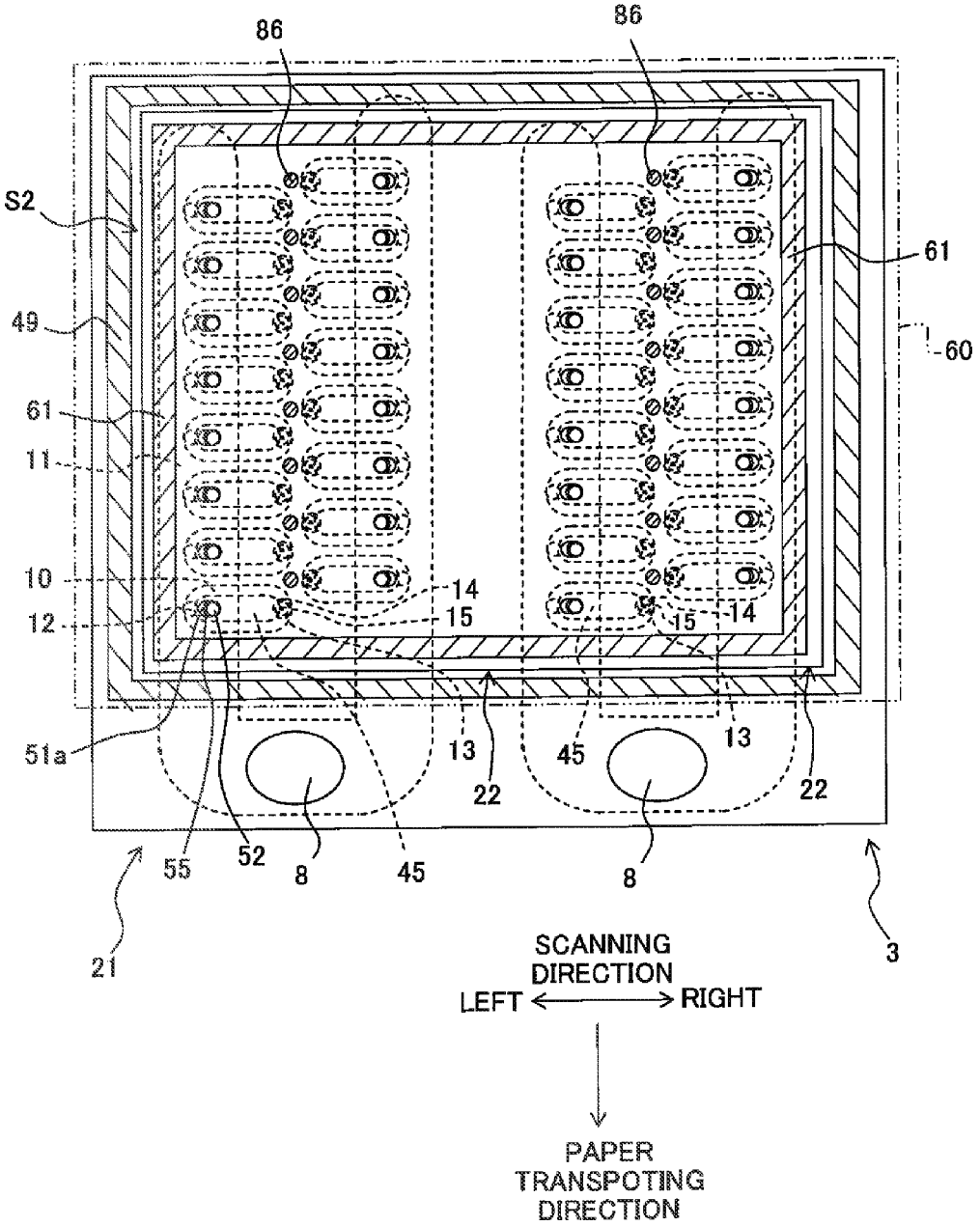
FIG. 9B shows another example in accordance with the sixth modification.

Further, as shown in FIG. 9B, if there are many rows of the pressure chambers 10, etc., the fixing member 61 may be arranged to encircle the area where the plurality of bumps 52 are arranged through the entire periphery in planar view, while the fixing members 86 are arranged to face the areas of the respective pressure chambers 10 in the channel unit 21, adjacent to the end portion side on which the bumps 52 are formed. In this case, in the same manner as in the above embodiment, it is possible to form the enclosed space S1, while positioning the fixing members 86 in the vicinity of the bumps 52, respectively. Therefore, when the fixing members 86 contract, it is possible to reliably cause the elastic deformation layer 51 to undergo elastic deformation in the portions on which the respective bumps 52 are arranged.

Further, in the above embodiment, the reinforcement frame 49 is arranged on the upper surface of the ink separation layer 41 to encircle the area where the plurality of bumps 52 are arranged through the entire periphery. However, the present teaching is not limited to this. For example, the reinforcement frame 49 may also be arranged intermittently on the upper surface of the ink separation layer 41 in an area encircling the plurality of bumps 52. In such case, the reinforcement frame 49 may be formed either by one member or by a plurality of members arranged apart from each other.

However, in this case, the enclosed space S2 of the above embodiment is not formed. Nevertheless, if the fixing member 61 is arranged in the same manner as in the above embodiment, then the enclosed space S1 is formed, and the plurality of bumps 52, the plurality of connection terminals 62, and the like are arranged in the enclosed space S1. By virtue of this, it is possible to prevent the bumps 52 from the migration, as well as from getting rusted, etc., by moisture.

Further, in the above example, at least one of the enclosed spaces S1 and S2 is formed. However, without being limited to this, it is possible to form neither of the enclosed spaces S1 and S2.

Further, in the above embodiment, by contact of the substrate 60 with the upper end of the reinforcement frame 49 for reinforcing the ink jetting head 3, the reinforcement frame 49 serves as a spacer for preventing the piezoelectric layer 43 and the substrate 60 from drawing too near to each other and thus causing the elastic deformation layer 51 to undergo excessive deformation. However, the present teaching is not limited to this.

Figure 10A:
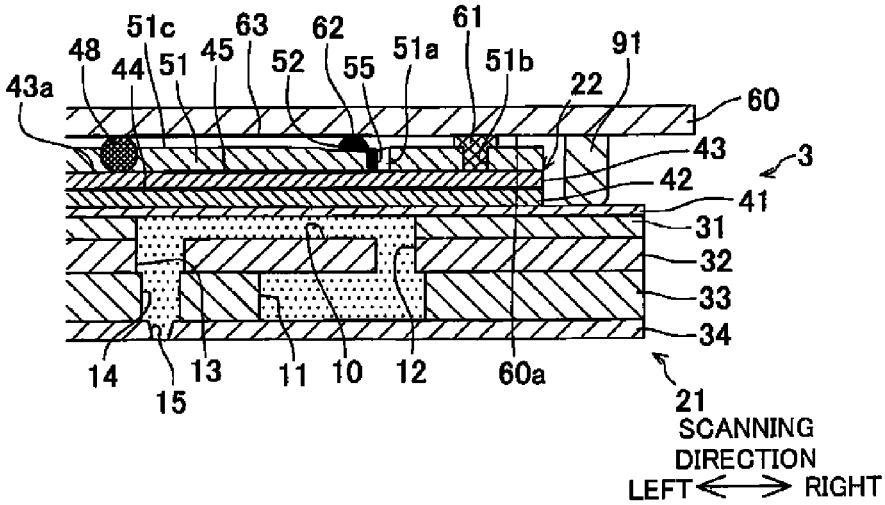
FIG. 10A is a view corresponding to FIG. 3 in accordance with a seventh modification.
Figure 10B:
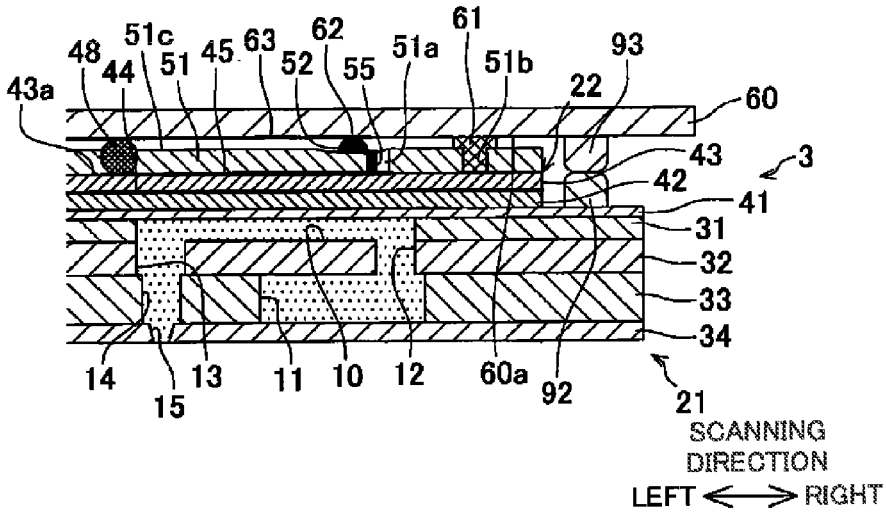
FIG. 10B is a view corresponding to FIG. 3 in accordance with an eighth modification.

For example, as shown in FIG. 10A, a projection 91 is provided on the lower surface 60*a* of the substrate 60 to project downward, and this projection 91 may serve as a spacer (a seventh modification). Alternatively, as shown in FIG. 10B, a reinforcement frame 92 lower in height than the reinforcement frame 49 is provided on the upper surface of the ink separation layer 41, while a projection 93 smaller in projection amount than the projection 91 is provided on the lower surface 60*a* of the substrate 60 in the portion facing the reinforcement frame 92. Thus, the combination of the reinforcement frame 92 and projection 93 may serve as a spacer (an eighth modification). Still alternatively, the spherical members 48 alone may also serve as a spacer.

Further, it is not indispensable to provide a spacer between the ink jetting head 3 and the substrate 60. For example, if the fixing member 61 does not have so great a contraction force, then it is possible not to provide any projection used to prevent the ink jetting head 3 and the substrate 60 from drawing too near to each other.

Further, in the above embodiment, the elastic deformation layer 51 is arranged on the upper surface 43*a* of the piezoelectric layer 43 to cover almost the entire area including the portion facing the pressure chambers 10, while the bumps 52 are arranged on the upper surface of the elastic deformation layer 51 to face the end portions of the pressure chambers 10 in the longitudinal direction. However, the present teaching is not limited to this.

For example, the bumps 52 may alternatively be arranged on the upper surface of the elastic deformation layer 51 in the portions facing the approximately central portions of the pressure chambers 10, respectively. Still alternatively, the pressure chambers 10 may have other shapes than the shape with one direction as its longitudinal direction such as a planar shape of an approximate circle and the like, while the bumps 52 may be arranged on the upper surface of the elastic deformation layer 51 to face any portions of the pressure chambers 10 respectively.

Figure 11:
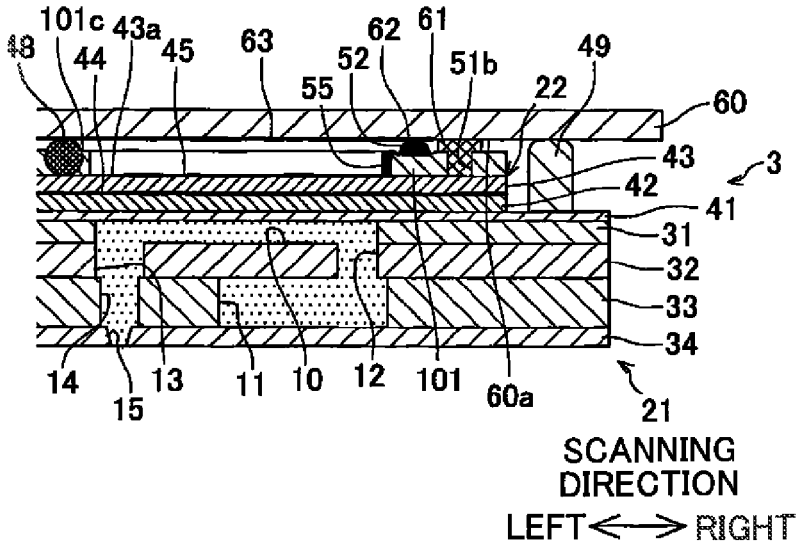
FIG. 11 is a view corresponding to FIG. 3 in accordance with a ninth modification.

Further, it is also not indispensable to arrange the bumps 52 on the upper surface of the elastic deformation layer 51 in the positions facing the pressure chambers 10. In a ninth modification, as shown in FIG. 11, an elastic deformation layer 101 is arranged on the upper surface 43*a* of the piezoelectric layer 43 to avoid the portion facing the pressure chambers 10. Then, the bumps 52 are arranged on an upper surface 101*a* of the elastic deformation layer 101 in the portions on the side of the through holes 12 of the pressure chambers 10 in the scanning direction. Further, while the elastic deformation layer 101 is arranged in the ninth modification to completely not face the pressure chambers 10, it is also possible to arrange the elastic deformation layer 101 to at least partially not face the pressure chambers 10.

In this case, because the elastic deformation layer 101 and bumps 52 do not face the pressure chambers 10, when driving the piezoelectric actuator 22, it is possible to restrain the elastic deformation layer 101 and bumps 52 from inhibiting the deformation of the piezoelectric layers 42 and 43, ink separation layer 41, and the like.

Here as in the ninth modification, if the elastic deformation layer 101 is arranged on the upper surface 43*a* of the piezoelectric layer 43 to avoid the portion facing the pressure chambers 10, then the elastic deformation layer 101 may be arranged either not to overlap any portion of the pressure chambers 10 or to overlap parts of the pressure chambers 10.

Further, in the ninth modification, the elastic deformation layer 101 is arranged on the upper surface 43*a* of the piezoelectric layer 43 to avoid the portion facing the pressure chambers 10. However, even if the bumps 52 are arranged not to face the pressure chambers 10, the elastic deformation layer 101 may still be arranged in some portion facing the pressure chambers 10. In such case, like the bumps 52, the elastic deformation layer 101 is also liable to inhibit the deformation of the piezoelectric layers 42 and 43, ink separation layer 41 and the like. However, because an elastic deformation layer has a small elastic coefficient, the elastic deformation layer 101 does not inhibit so much of the deformation of the piezoelectric layers 42 and 43, and ink separation layer 41.

Further, as is understood from the above embodiment, as well as from the first to ninth modifications, it is possible to arrange the bumps 52 on the upper surface of the elastic deformation layer either in portions facing the pressure chambers 10 or in portions not facing the pressure chambers 10, thereby increasing the degree of freedom for arrangement of the bumps 52.

Further, in the above embodiment, the through hole 51*b* is formed in the elastic deformation layer 51, and thus the upper surface 43*a* of the piezoelectric layer 43 has a portion on which the elastic deformation layer 51 is not arranged, while the fixing member 61 fixes the upper surface 43*a* of the piezoelectric layer 43 and the lower surface 60*a* of the substrate 60 to each other. However, the present teaching is not limited to this.

Figure 12:
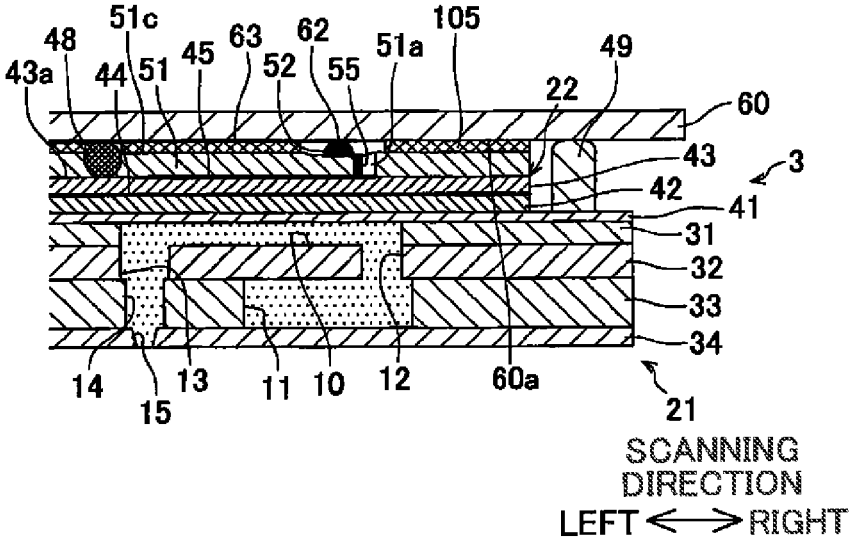
FIG. 12 is a view corresponding to FIG. 3 in accordance with a tenth modification.

In a tenth modification, as shown in FIG. 12, the through hole 51*b* (see FIG. 3) is not formed in the elastic deformation layer 51, but the layer of a fixing member 105 is arranged between the elastic deformation layer 51 and the substrate 60 to extend continuously across the plurality of pressure chambers 10, and the fixing member 105 fixes the elastic deformation layer 51 and the substrate 60 to each other.

In this case, when fixing the elastic deformation layer 51 and the substrate 60 to each other, the contraction force of the fixing member 105 causes the substrate 60, and the elastic deformation layer 51 with the piezoelectric actuator 22 joined to its lower surface to move in the directions of approaching each other. By virtue of this, the portions of the elastic deformation layer 51 on which the bumps 52 are arranged are sandwiched by the piezoelectric actuator 22 and the substrate 60 to undergo elastic deformation. Then, due to the reaction force arising from the tendency for those elastic-deformed portions of the elastic deformation layer 51 to restore the previous state before elastic deformation, the bumps 52 are caused to contact with the connection terminals 62.

However, as described earlier, the elastic deformation layer 51 is less strong than the piezoelectric layer 43. Therefore, in the tenth modification, by forming the layer of the fixing member 105 on the upper surface 51*c* of the elastic deformation layer 51 to extend continuously across the plurality of pressure chambers 10, the area for the fixing member 105 to conjoin the elastic deformation layer 51 and the substrate 60 becomes larger than the area for the fixing member 61 to conjoin the piezoelectric layer 43 and the substrate 60 in the above embodiment. By virtue of this, it is possible to secure the conjunction strength between the piezoelectric actuator 22 and the substrate 60. Further, in the tenth modification, because it is only necessary to form the layer of the fixing member 105 on the upper surface 51*c* of the elastic deformation layer 51 in the above manner, it is possible to easily form the fixing member 105.

Further, in the above examples, the ink jetting head 3 and the substrate 60 are fixed to each other by the fixing member 61 formed by an adhesive which contracts when hardening. However, the present teaching is not limited to this. The ink jetting head 3 and the substrate 60 may also be fixed to each other by a fixing member other than adhesives. For example, the fixing member may be an approximately U-shaped member which is made of a contractable material of synthetic resin, and arranged to sandwich the mutually stacked ink jetting head 3 and substrate 60 from above and from below. In such case, by contracting the fixing member made of a material of synthetic resin, mutual fixation is realized between the ink jetting head 3 and the substrate 60 sandwiched from above and from below by the fixing member. Alternatively, the fixing member may also be formed by a shape-memory alloy. In such case, the ink jet heat 3 and the substrate 60 may be fixed to each other by making use of the force arising from a tendency for the fixing member to restore its original shape when the fixing member is heated or cooled to a predetermined temperature.

Further, the fixing member is also not necessarily a member which contracts when fixing the ink jetting head 3 and the substrate 60. For example, the fixing member may be a set of screws, and the ink jetting head 3 and the substrate 60 may be fixed to each other by fixing the substrate 60 to the reinforcement frame 49 by the screws.

In those cases, when fixing the ink jetting head 3 and the substrate 60 to each other, the ink jetting head 3 and the substrate 60 also have a tendency to draw near to each other. Then, by virtue of this, the portions of the elastic deformation layer 51 on which the bumps 52 are formed are sandwiched by the piezoelectric layer 43 and the substrate 60 to undergo elastic deformation.

Further, in the above embodiment, the piezoelectric actuator 22 is connected to the hard substrate 60. However, without being limited to this, the piezoelectric actuator 22 may also be connected to a flexible substrate such as an FPC or the like.

Further, in the above examples, the ink jetting head 3 is provided with the channel unit 21 having ink channels including the nozzles 15 and the pressure chambers 10, and the piezoelectric actuator 22 applying a pressure to the ink inside the pressure chambers 10. However, without being limited to this, the ink jetting head 3 may also be provided with, for example, an actuator other than piezoelectric actuators to apply jet energy to the ink inside the ink channels. Further, the channel unit 21 may also be formed by silicon, while the piezoelectric layers may each be a thin film formed by adopting a sol-gel method, sputtering method, or the like.

Further, while the above explanations are made with an example of applying the present teaching to a printer which carries out printing by jetting ink from nozzles, the present teaching is not limited to this. It is also possible to apply the present teaching to any liquid jetting apparatuses jetting other liquids than ink. Further, it is also possible to apply the present teaching to such other apparatuses than those jetting liquids as having a connecting structure formed by connecting a substrate with a structure other than a liquid jetting head.

What is claimed is:

1. A liquid jetting apparatus configured to jet a liquid comprising:

a liquid jetting head including:

a channel unit in which a plurality of channels including a plurality of nozzles and a plurality of pressure chambers communicating with the nozzles is formed, and a piezoelectric actuator including a piezoelectric layer stacked on the channel unit to cover the pressure chambers and a plurality of individual electrodes facing the pressure chambers;

an elastic deformation layer arranged on a surface, of the piezoelectric actuator, on a side opposite to the channel unit;

a plurality of head-side contact points arranged on a surface, of the elastic deformation layer, on a side opposite to the piezoelectric actuator, and being in electrical conduction with the individual electrodes;

a substrate arranged to face a surface, of the liquid jetting head, on a side of the piezoelectric actuator;

a plurality of substrate-side contact points arranged on a surface, of the substrate, on a side of the liquid jetting head so that the substrate-side contact points face the head-side contact points; and a fixing member configured to fix the liquid jetting head and the substrate to each other, wherein the elastic deformation layer is configured such that under a condition that the fixation member fixes the liquid jetting head and the substrate, a portion of the elastic deformation layer, on which the head-side contact points are arranged, is sandwiched by the piezoelectric actuator and the substrate to undergo elastic deformation, while pressing the head-side contact points to contact with the substrate-side contact points by a force arising from a tendency to restore a state before elastic deformation.

2. The liquid jetting apparatus according to claim 1, wherein the fixing member is formed by a resin material which has contracted in hardening.

3. The liquid jetting apparatus according to claim 2, further comprising a spacer arranged between the liquid jetting head and the substrate.

4. The liquid jetting apparatus according to claim 3, wherein the spacer is a frame which is configured to be arranged on a surface of the channel unit on the piezoelectric actuator side to encircle the piezoelectric actuator and whose end on the opposite side to the channel unit contacts with the substrate, so as to reinforce the rigidity of the liquid jetting head.

5. The liquid jetting apparatus according to claim 4, wherein the spacer is arranged to surround the plurality of head-side contact points entirely, and an enclosed space is defined by the liquid jetting head, the substrate, and the spacer.

6. The liquid jetting apparatus according to claim 3, wherein the spacer includes a plurality of spacers arranged between the piezoelectric layer and the substrate to face such an area of the channel unit which the pressure chambers are not formed.

7. The liquid jetting apparatus according to claim 6, wherein the plurality of spacers are spherical members which are embedded in the surface of the elastic deformation layer on the side opposite to the piezoelectric actuator, to project toward the substrate from the surface of the elastic deformation layer on the side opposite to the piezoelectric actuator.

8. The liquid jetting apparatus according to claim 2, wherein the fixing member is an adhesive which is arranged between the liquid jetting head and the substrate to contact with both at least part of the liquid jetting head and at least part of the substrate, and which has contracted in hardening.

9. The liquid jetting apparatus according to claim 8, wherein the liquid jetting head includes a hole formed in a surface thereof on a side of the substrate, and the fixing member penetrates into the hole.

10. The liquid jetting apparatus according to claim 9, wherein the channel unit includes a nozzle plate which is formed by a translucent material of synthetic resin and in which the plurality of nozzles are formed, and a channel member which is formed by the other parts of the liquid channels than the plurality of nozzles, and stacked on a surface, of the nozzle plate, on a side of the piezoelectric actuator; and the hole penetrates through the channel member, while an end of the hole on a side opposite to the substrate is sealed by the nozzle plate.

11. The liquid jetting apparatus according to claim 9, wherein the channel unit includes a nozzle plate in which the plurality of nozzles are formed, and a channel member which is formed by the other parts of the liquid channels than the plurality of nozzles, and stacked on a surface, of the nozzle plate, on a side of the piezoelectric actuator; and the hole penetrates through both the nozzle plate and the channel member.

12. The liquid jetting apparatus according to claim 8, wherein the fixing member is arranged to surround the plurality of head-side contact point entirely.

13. The liquid jetting apparatus according to claim 12, wherein an enclosed space is defined by the liquid jetting head, the substrate, and the fixing member.

14. The liquid jetting apparatus according to claim 8, wherein the fixing member includes a plurality of fixing members which are positioned between the plurality of head-side contact points.

15. The liquid jetting apparatus according to claim 8, wherein a surface of the piezoelectric layer on a side opposite to the channel unit includes an absent portion in which the elastic deformation layer is not arranged, and the fixing member mutually fixes the substrate and the absent portion.

16. The liquid jetting apparatus according to claim 8, wherein a layer of the fixing member is arranged between the elastic deformation layer and the substrate to extend continuously across the plurality of pressure chambers.

17. The liquid jetting apparatus according to claim 8, wherein a through hole is formed in the substrate, and the fixing member penetrates into the through hole.

18. The liquid jetting apparatus according to claim 17, wherein the fixing member is a photo-curable adhesive.

19. The liquid jetting apparatus according to claim 1, wherein the elastic deformation layer is arranged on a surface, of the piezoelectric layer, on a side opposite to the channel unit to face the plurality of pressure chambers, and the plurality of head-side contact points are arranged on the surface, of the elastic deformation layer, on the side opposite to the piezoelectric actuator in portions respectively facing the plurality of pressure chambers.

20. The liquid jetting apparatus according to claim 19, wherein the plurality of pressure chambers each have an elongate shape in a longitudinal direction; and the plurality of head-side contact points are arranged on the surface, of the elastic deformation layer, on the side opposite to the piezoelectric actuator in portions respectively facing end portions of the plurality of pressure chambers in the longitudinal direction.

21. The liquid jetting apparatus according to claim 20, wherein the fixing member is an adhesive which is arranged between the piezoelectric layer and the substrate to contact with both at least part of the piezoelectric layer and at least part of the substrate, which has contracted in hardening, and which is arranged to face an area adjacent to the pressure chambers of the channel unit on a side of the end portion.

22. The liquid jetting apparatus according to claim 1, wherein the elastic deformation layer is arranged on a surface, of the piezoelectric layer, on a side opposite to the channel unit to avoid portion facing the plurality of pressure chambers.

23. The liquid jetting apparatus according to claim 1, wherein the elastic deformation layer is formed of a conductive material and segmented according to each of the plurality of head-side contact points, and the plurality of head-side contact points are in electrical conduction with the liquid jetting head via the elastic deformation layer.

24. The liquid jetting apparatus according to claim 23, wherein the elastic deformation layer is formed of a conductive polymer, and a junction surface of the conductive polymer with the piezoelectric layer is configured to serve as the individual electrodes.

25. A connecting structure of substrate comprising:

a substrate;

a structure arranged to face the substrate;

an elastic deformation layer arranged on a surface of the structure on a side of the substrate, and sandwiched by the substrate and the structure;

a plurality of structure-side contact points arranged on a surface of the elastic deformation layer on a side of the substrate to be in electrical conduction with the structure;

a plurality of substrate-side contact points arranged on a surface of the substrate on a side of the structure to face the plurality of structure-side contact points; and a fixing member configured to fix the substrate and the structure to each other, wherein the elastic deformation layer is configured such that under a condition that the fixing member fixes the substrate and the structure, a portion of the elastic deformation layer, on which the structure-side contact points are provided, is sandwiched by the substrate and the structure to undergo elastic deformation, while pressing the plurality of structure-side contact points to contact with the substrate-side contact points by a force arising from a tendency to restore a state before elastic deformation.

26. A method for manufacturing a liquid jetting apparatus, the liquid jetting apparatus comprising:

a liquid jetting head including:

a channel unit in which liquid channels including a plurality of nozzles and a plurality of pressure chambers communicating with the nozzles is formed, and a piezoelectric actuator including a piezoelectric layer stacked on the channel unit to cover the plurality of pressure chambers and having a plurality of individual electrodes arranged on a surface of the piezoelectric layer on a side opposite to the channel unit to face the pressure chambers; and a substrate arranged to face a surface of the liquid jetting head on a side of the piezoelectric actuator, wherein a plurality of substrate-side contact points are arranged on a surface of the substrate on a side of the liquid jetting head to correspond respectively to the individual electrodes, the method comprising:

forming an elastic deformation layer on a surface of the piezoelectric actuator on a side opposite to the channel unit;

forming a plurality of head-side contact points on a surface of the elastic deformation layer on a side of the substrate in portions respectively facing the substrate-side contact points to be in electrical conduction with the plurality of individual electrodes; and fixing the liquid jetting head and the substrate to each other with a fixing member, wherein fixing the liquid jetting head and the substrate to each other with the fixing member causes a portion of the elastic deformation layer, on which the head-side contact points are arranged, to be sandwiched by the piezoelectric actuator and the substrate and thus to undergo elastic deformation, while pressing the head-side contact points to contact with the substrate-side contact points by a force arising from a tendency for the elastic deformation layer to restore a state before elastic deformation.

27. The method for manufacturing the liquid jetting apparatus according to claim 26, wherein a through hole is formed in the substrate; the fixing member is formed by an adhesive which contracts when hardening; and fixing the liquid jetting head and the substrate comprises: arranging the substrate to face the surface of the liquid jetting head on a side of the piezoelectric actuator, forming the adhesive between the liquid jetting head and the substrate by way of an ink jet method of dropping the adhesive toward the through hole from the side opposite to the substrate to the liquid jetting head, and hardening the adhesive.

28. The method for manufacturing the liquid jetting apparatus according to claim 27, wherein when forming the elastic deformation layer, the elastic deformation layer is formed by way of the ink jet method; and when forming the head-side contact points, the head-side contact points are formed by way of the ink jet method.

* * * * *